US007906909B2

(12) United States Patent
Park et al.

(10) Patent No.: US 7,906,909 B2
(45) Date of Patent: Mar. 15, 2011

(54) PLASMA DISPLAY PANEL

(75) Inventors: Bumhee Park, Gumi (KR); Yoonlae Cho, Gumi (KR); Sangchul Hwang, Gumi (KR)

(73) Assignee: LG Electronics Inc., Seoul (KR)

( * ) Notice: Subject to any disclaimer, the term of this patent is extended or adjusted under 35 U.S.C. 154(b) by 311 days.

(21) Appl. No.: 12/165,953

(22) Filed: Jul. 1, 2008

(65) Prior Publication Data

US 2009/0009083 A1 Jan. 8, 2009

(30) Foreign Application Priority Data

Jul. 3, 2007 (KR) ..... 10-2007-0066540

(51) Int. Cl.
*H01J 17/49* (2006.01)

(52) U.S. Cl. ..... 313/587; 313/586

(58) Field of Classification Search ..... 313/582–587
See application file for complete search history.

(56) References Cited

U.S. PATENT DOCUMENTS 5,932,968 A 8/1999 Ghosh et al. ..... 313/582
6,919,670 B2 * 7/2005 Kawanami et al. ..... 313/292
6,919,685 B1 * 7/2005 Henderson et al. ..... 313/582
2001/0042853 A1 * 11/2001 Hampden-Smith et al. ..... 252/301.4 R
2007/0001602 A1 * 1/2007 Miyake et al. ..... 313/582

FOREIGN PATENT DOCUMENTS

JP 11-043670 A 2/1999
KR 10-2006-0088403 A 8/2006

OTHER PUBLICATIONS

European Search Report dated Feb. 10, 2010 for Application No. 08 159 529.0.

* cited by examiner

*Primary Examiner* — Bumsuk Won
(74) *Attorney, Agent, or Firm* — Ked & Associates, LLP

(57) ABSTRACT

A plasma display panel is disclosed. The plasma display panel includes a front substrate, a rear substrate facing the front substrate, a barrier rib that is positioned between the front and rear substrates and partitions a discharge cell, and a phosphor layer formed inside the discharge cell. The phosphor layer includes a first phosphor layer emitting first color light, a second phosphor layer emitting second color light, and a third phosphor layer emitting third color light. The first phosphor layer includes a first pigment, and the second phosphor layer includes a second pigment. An average particle size of the second phosphor layer is larger than an average particle size of the first phosphor layer, and a content of the second pigment is more than a content of the first pigment.

20 Claims, 20 Drawing Sheets

| | Phosphor material | Pigment |
|---|---|---|
| First phosphor layer | First phosphor material (Y, Gd)BO:Eu | Red pigment (Fe) |
| Second phosphor layer | Second phosphor material (Ba, Sr, Eu)$MgAl_{10}O_{17}$ | Blue pigment (Co) |
| Third phosphor layer | Third phosphor material ($Zn_2SiO_4:Mn^{2+}$ $YBO_3:Tb^{3+}$) | |

FIG. 6

| $C_1/L_1$ | Reflectance | Luminance |
|---|---|---|
| 0.001 | X | ◎ |
| 0.003 | X | ◎ |
| 0.005 | ○ | ◎ |
| 0.007 | ○ | ◎ |
| 0.01 | ◎ | ◎ |
| 0.03 | ◎ | ◎ |
| 0.07 | ◎ | ◎ |
| 0.15 | ◎ | ◎ |
| 0.37 | ◎ | ◎ |
| 0.72 | ◎ | ◎ |
| 1.13 | ◎ | ◎ |
| 2.3 | ◎ | ◎ |
| 3.0 | ◎ | ◎ |
| 5.1 | ◎ | ○ |
| 6.0 | ◎ | ○ |
| 8.0 | ◎ | X |

| | |
|---|---|
| ◎ | : Excellent |
| ○ | : Good |
| X | : Bad |

FIG. 7

| $C_2/L_2$ | Reflectance | Luminance |
|---|---|---|
| 0.005 | X | ◎ |
| 0.01 | ○ | ◎ |
| 0.03 | ○ | ◎ |
| 0.05 | ◎ | ◎ |
| 0.07 | ◎ | ◎ |
| 1.2 | ◎ | ◎ |
| 1.9 | ◎ | ◎ |
| 2.5 | ◎ | ◎ |
| 3.2 | ◎ | ◎ |
| 4.0 | ◎ | ◎ |
| 4.2 | ◎ | ○ |
| 5.7 | ◎ | ○ |
| 6.3 | ◎ | ○ |
| 7.2 | ◎ | ○ |
| 8.0 | ◎ | ○ |
| 10.0 | ◎ | X |

| | |
|---|---|
| ◎ | : Excellent |
| ○ | : Good |
| X | : Bad |

Content of blue pigment > Content of red pigment

| | Phosphor material | Pigment |
|---|---|---|
| First phosphor layer | First phosphor material (Y, Gd)BO:Eu | Red pigment (Fe) |
| Second phosphor layer | Second phosphor material (Ba, Sr, Eu)$MgAl_{10}O_{17}$ | Blue pigment (Co) |
| Third phosphor layer | Third phosphor material ($Zn_2SiO_4$:$Mn^{2+}$ $YBO_3$:$Tb^{3+}$) | Green pigment (Zn) |

FIG. 14A

| Content of green pigment | Reflectance |
|---|---|
| 0 | 28% |
| 0.01 | 26.5% |
| 0.05 | 26.2% |
| 0.1 | 26% |
| 0.2 | 25.9% |
| 2.5 | 24.3% |
| 3 | 24% |
| 4 | 23.8% |
| 5 | 23.5% |
| 7 | 22.8% |

PLASMA DISPLAY PANEL

This application claims the benefit of Korean Patent Application No. 10-2007-0066540 filed on Jul. 3, 2007, which is hereby incorporated by reference.

BACKGROUND

1. Field

An exemplary embodiment of the invention relates to a plasma display panel.

2. Description of the Related Art

A plasma display panel includes a phosphor layer inside discharge cells partitioned by barrier ribs and a plurality of electrodes.

A driving signal is supplied to the electrodes, thereby generating a discharge inside the discharge cells. When the driving signal generates a discharge inside the discharge cells, a discharge gas filled inside the discharge cells generates vacuum ultraviolet rays, which thereby cause phosphors formed inside the discharge cells to emit light, thus displaying an image on the screen of the plasma display panel.

SUMMARY

An exemplary embodiment of the invention provides a plasma display panel capable of improving a contrast characteristic by reducing the reflection of light caused by a phosphor layer.

In one aspect, a plasma display panel comprises a front substrate, a rear substrate facing the front substrate, a barrier rib that is positioned between the front substrate and the rear substrate and partitions a discharge cell, and a phosphor layer formed inside the discharge cell, the phosphor layer including a first phosphor layer emitting first color light, a second phosphor layer emitting second color light, and a third phosphor layer emitting third color light, wherein the first phosphor layer includes a first pigment, and the second phosphor layer includes a second pigment, an average particle size of the second phosphor layer is larger than an average particle size of the first phosphor layer, and a content of the second pigment is more than a content of the first pigment.

In another aspect, a plasma display panel comprises a front substrate, a rear substrate facing the front substrate, a barrier rib that is positioned between the front substrate and the rear substrate and partitions a discharge cell, and a phosphor layer formed inside the discharge cell, the phosphor layer including a first phosphor layer emitting first color light, wherein the first phosphor layer includes a first pigment, wherein a content of the first pigment satisfies the following equation: $0.005 \leqq C1/L1 \leqq 6$, where C1 is a content of the first pigment in units of parts by weight, and L1 is an average particle size of the first phosphor material in units of micrometer.

In still another aspect, a plasma display panel comprises a front substrate, a rear substrate facing the front substrate, a barrier rib that is positioned between the front substrate and the rear substrate and partitions a discharge cell, and a phosphor layer formed inside the discharge cell, the phosphor layer including a second phosphor layer emitting second color light, wherein the second phosphor layer includes a second pigment, wherein a content of the second pigment satisfies the following equation: $0.01 \leqq C2/L2 \leqq 8$, where C2 is a content of the second pigment in units of parts by weight, and L1 is an average particle size of the second phosphor material in units of micrometer.

BRIEF DESCRIPTION OF THE DRAWINGS

The accompany drawings, which are included to provide a further understanding of the invention and are incorporated on and constitute a part of this specification, illustrate embodiments of the invention and together with the description serve to explain the principles of the invention. In the drawings:

FIG. 6 is a diagram for explaining a relationship between the size of a first phosphor particle and a content of a red pigment;

FIG. 7 is a diagram for explaining a relationship between the size of a second phosphor particle and a content of a blue pigment;

FIGS. 14A and 14B are a table and a graph showing a reflectance and a luminance of a plasma display panel depending on changes in a content of a green pigment, respectively.

DETAILED DESCRIPTION OF EMBODIMENTS

Reference will now be made in detail embodiments of the invention examples of which are illustrated in the accompanying drawings.

FIGS. 1A to 1D show a structure of a plasma display panel according to an exemplary embodiment of the invention.

Figure 1A:
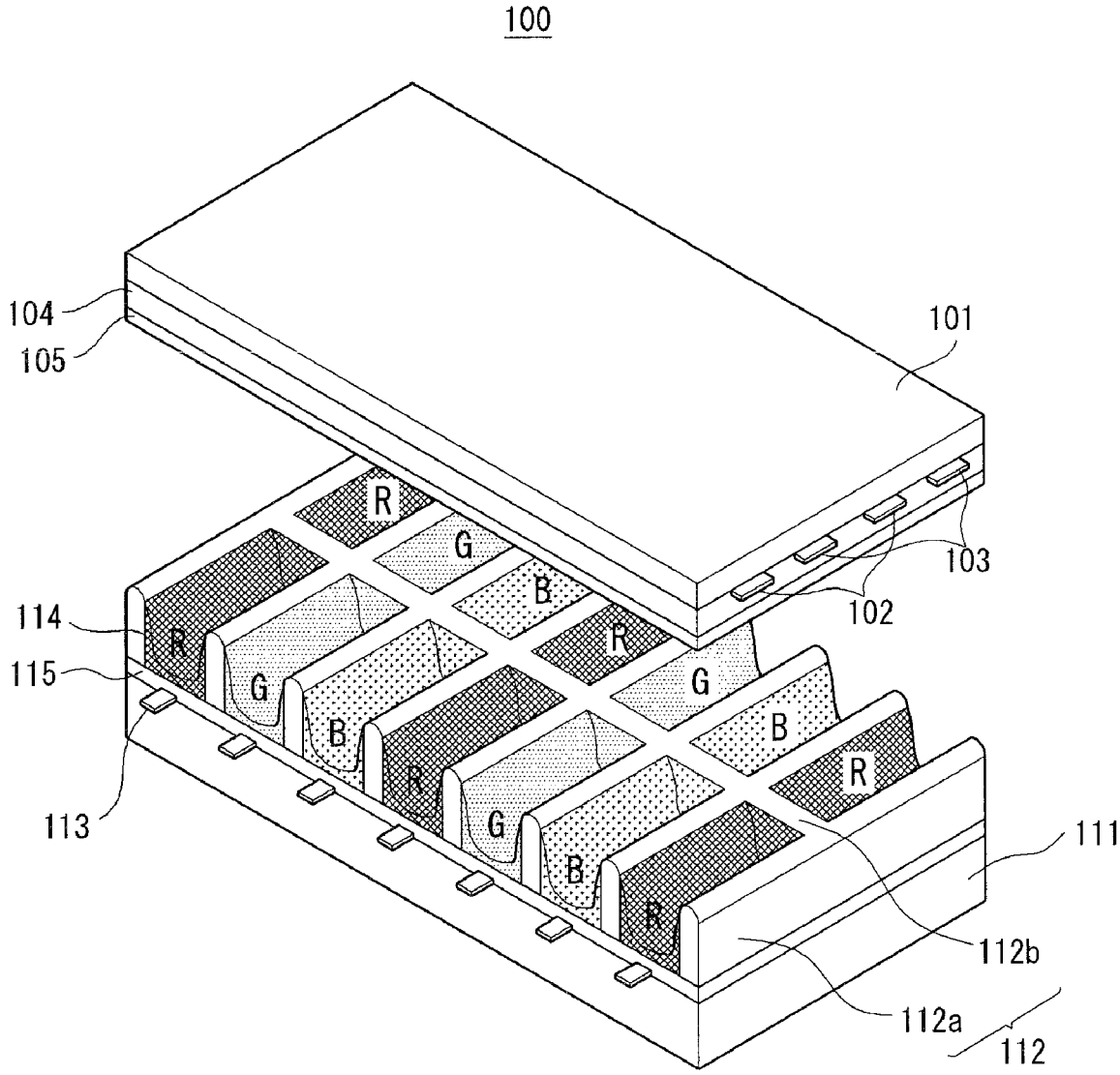
FIGS. 1A to 1D show a structure of a plasma display panel according to an exemplary embodiment of the invention.

As shown in FIG. 1A, a plasma display panel 100 according to an exemplary embodiment of the invention includes a front substrate 101 and a rear substrate 111 which coalesce with each other using a seal layer (not shown) to face each other. On the front substrate 101, a scan electrode 102 and a sustain electrode 103 are formed parallel to each other. On the rear substrate 111, an address electrode 113 is positioned to intersect the scan electrode 102 and the sustain electrode 103.

An upper dielectric layer 104 covering the scan electrode 102 and the sustain electrode 103 is positioned on the front substrate 101 on which the scan electrode 102 and the sustain electrode 103 are positioned.

The upper dielectric layer 104 limits discharge currents of the scan electrode 102 and the sustain electrode 103, and provides electrical insulation between the scan electrode 102 and the sustain electrode 103.

A protective layer 105 is positioned on the upper dielectric layer 104 to facilitate discharge conditions. The protective layer 105 may include a material having a high secondary electron emission coefficient, for example, magnesium oxide (MgO).

A lower dielectric layer 115 covering the address electrode 113 is positioned on the rear substrate 111 on which the address electrode 113 is positioned. The lower dielectric layer 115 provides electrical insulation of the address electrodes 113.

Barrier ribs 112 of a stripe type, a well type, a delta type, a honeycomb type, and the like, are positioned on the lower dielectric layer 115 to partition discharge spaces (i.e., discharge cells). A red discharge cell, a green discharge cell, and a blue discharge cell may be positioned between the front substrate 101 and the rear substrate 111. In addition to the red, green, and blue discharge cells, a white or yellow discharge cell may be formed.

Each discharge cell partitioned by the barrier ribs 112 is filled with a discharge gas including xenon (Xe), neon (Ne), and so forth.

A phosphor layer 114 is positioned inside the discharge cells to emit visible light for an image display during the generation of an address discharge. For instance, first, second and third phosphor layers respectively emitting red, blue, and green light may be positioned inside the discharge cells. In addition to the red, green, and blue light, a phosphor layer emitting white or yellow light may be positioned in the discharge cell.

A thickness of the phosphor layer 114 inside at least one of the red, green, and blue discharge cells may be different from thicknesses of the phosphor layers 114 inside the other discharge cells. For example, a thickness of the third phosphor layer 114 inside the green discharge cell and a thickness of the second phosphor layer 114 inside the blue discharge cell may be larger than a thickness of the first phosphor layer 114 inside the red discharge cell. The thickness of the third phosphor layer 114 inside the green discharge cell my be equal to or different from the thickness of the second phosphor layer 114 inside the blue discharge cell.

In the plasma display panel 100 according to the exemplary embodiment of the invention, widths of the red, green, and blue discharge cells may be substantially equal to one another. However, a width of at least one of the red, green, and blue discharge cells may be different from the widths of the other discharge cells. For example, a width of the red discharge cell is the smallest, and widths of the green and blue discharge cells are larger than the width of the red discharge cell. The width of the green discharge cell may be equal to or different from the width of the blue discharge cell.

Widths of the phosphor layers 114 inside the discharge cells change depending on the widths of the discharge cells. For example, a width of the second phosphor layer 114 inside the blue discharge cell and a width of the third phosphor layer 114 inside the green discharge cell are larger than a width of the first phosphor layer 114 inside the red discharge cell. Hence, a color temperature characteristic of an image can be improved.

The plasma display panel 100 according the exemplary embodiment may have various forms of barrier rib structures as well as a structure of the barrier rib 112 shown in FIG. 1A. For instance, the barrier rib 112 includes a first barrier rib 112*b* and a second barrier rib 112*a*. The barrier rib 112 may have a differential type barrier rib structure in which heights of the first and second barrier ribs 112*b* and 112*a* are different from each other.

In the differential type barrier rib structure, a height of the first barrier rib 112*b* may be smaller than a height of the second barrier rib 112*a*.

While FIG. 1A has been shown and described the case where the red, green, and blue discharge cells are arranged on the same line, the red, green, and blue discharge cells may be arranged in a different pattern. For instance, a delta type arrangement in which the red, green, and blue discharge cells are arranged in a triangle shape may be applicable. Further, the discharge cells may have a variety of polygonal shapes such as pentagonal and hexagonal shapes as well as a rectangular shape.

While FIG. 1A has shown and described the case where the barrier rib 112 is formed on the rear substrate 111, the barrier rib 112 may be formed on at least one of the front substrate 101 or the rear substrate 111.

It should be noted that only one example of the plasma display panel according to the exemplary embodiment has been shown and described above, and the exemplary embodiment is not limited to the plasma display panel with the above-described structure. For instance, while the above description illustrates a case where the upper dielectric layer 104 and the lower dielectric layer 115 each have a single-layered structure, at least one of the upper dielectric layer 104 or the lower dielectric layer 115 may have a multi-layered structure.

While the address electrode 113 positioned on the rear substrate 111 may have a substantially constant width or thickness, a width or thickness of the address electrode 113 inside the discharge cell may be different from a width or thickness of the address electrode 113 outside the discharge cell. For instance, a width or thickness of the address electrode 113 inside the discharge cell may be larger than a width or thickness of the address electrode 113 outside the discharge cell.

Figure 1B:
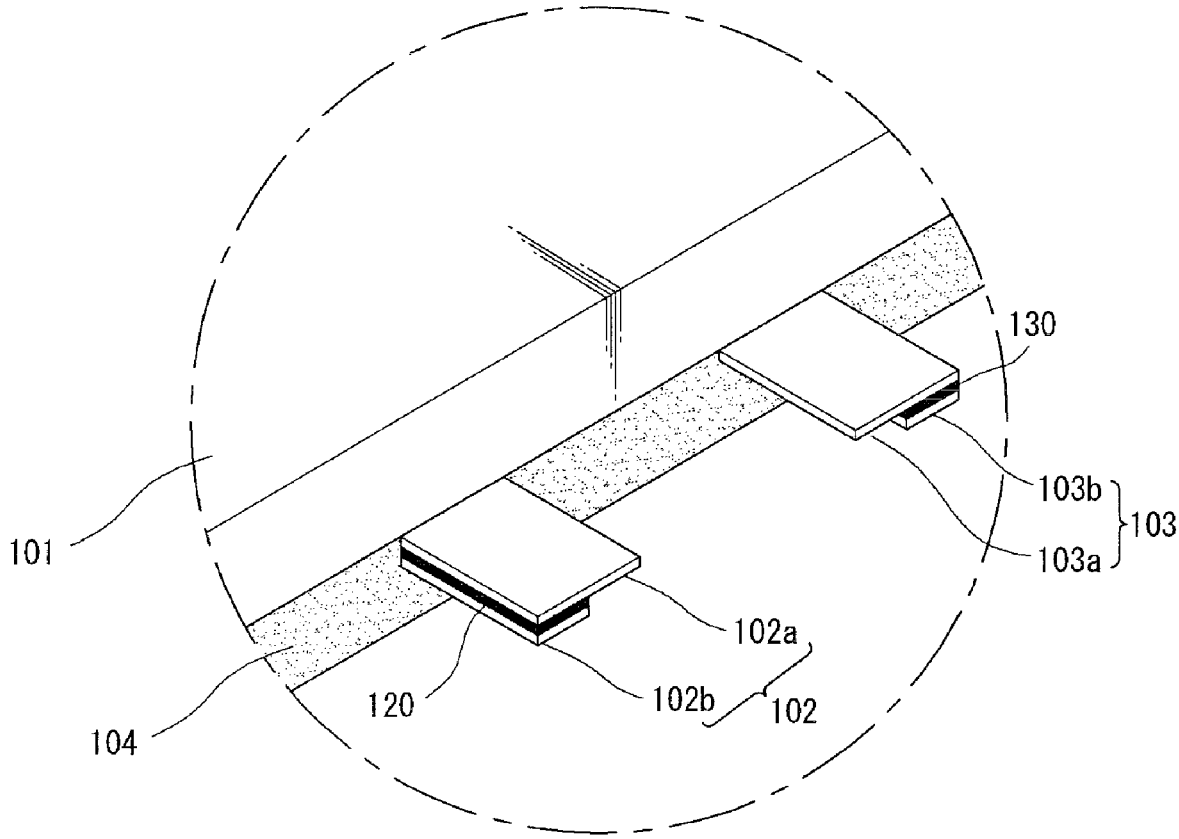

FIG. 1B shows another structure of the scan electrode 102 and the sustain electrode 103.

The scan electrode 102 and the sustain electrode 103 may have a multi-layered structure, respectively. For instance, the scan electrode 102 and the sustain electrode 103 each include transparent electrodes 102*a* and 103*a* and bus electrodes 102*b* and 103*b*.

The bus electrodes 102*b* and 103*b* may include a substantially opaque material, for instance, at least one of silver (Ag), gold (Au), or aluminum (Al). The transparent electrodes 102*a* and 103*a* may include a substantially transparent material, for instance, indium-tin-oxide (ITO).

Black layers 120 and 130 are formed between the transparent electrodes 102*a* and 103*a* and the bus electrodes 102*b* and 103*b* to prevent the reflection of external light caused by the bus electrodes 102*b* and 103*b*.

The transparent electrodes 102*a* and 103*a* may be omitted from the scan electrode 102 and the sustain electrode 103. In other words, the scan electrode 102 and the sustain electrode 103 may be called an ITO-less electrode in which the transparent electrodes 102*a* and 103*a* are omitted.

Figure 1C:
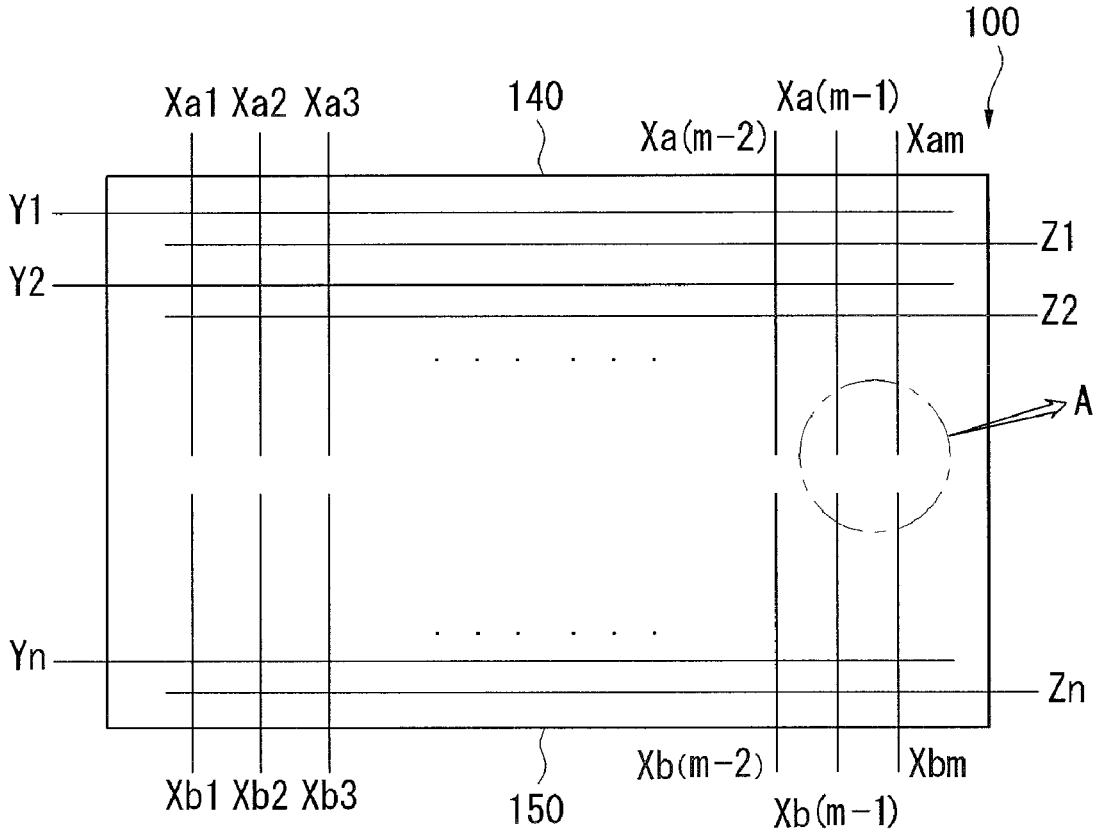

As shown in FIG. 1C, the plasma display panel 100 may be divided into a first area 140 and a second area 150.

In the first area 140, a plurality of first address electrodes Xa1, Xa1, . . . , Xam are positioned parallel to one another. In the second area 150, a plurality of second address electrodes Xb1, Xb1, . . . , Xbm are positioned parallel to one another to be opposite to the plurality of first address electrodes Xa1, Xa1, . . . , Xam.

For example, in case the first address electrodes Xa1, Xa1, . . . , Xam are positioned parallel to one another in turn in the first area 140, the second address electrodes Xb1, Xb1, . . . , Xbm respectively corresponding to the first address electrodes Xa1, Xa1, . . . , Xam are positioned parallel to one another in the second area 150. In other words, the first address electrode Xa1 is opposite to the second address electrode Xb1, and the first address electrode Xam is opposite to the second address electrode Xbm.

Figure 1D:
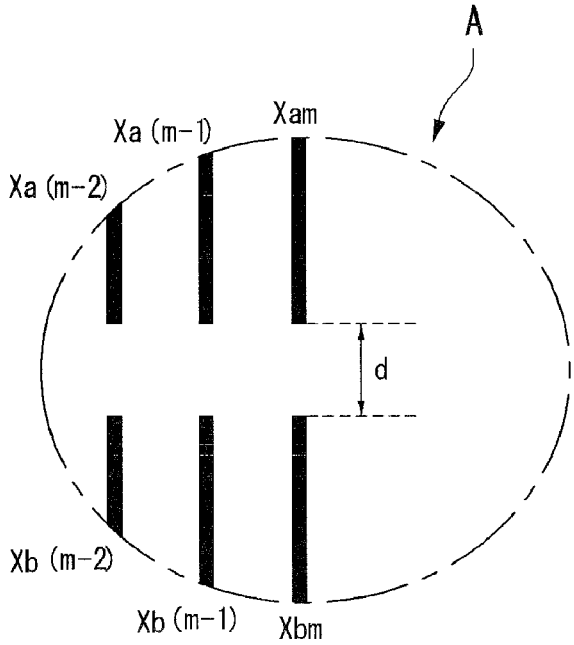

FIG. 1D shows in detail an area A where the first address electrodes and the second address electrodes are opposite to each other.

As shown in FIG. 1D, the first address electrodes Xa(m-2), Xa(m-1) and Xam are opposite to the second address electrodes Xb(m-2), Xb(m-1) and Xbm with a distance d therebetween, respectively.

When the distance d between the first address electrode and the second address electrode is excessively short, it is likely that a current flows due to a coupling effect between the first address electrode and the second address electrode. On the other hand, when the distance d is excessively long, a viewer may watch a striped noise on an image displayed on the plasma display panel.

Considering this, the distance d may lie in a range between about 50 μm and 300 μm. Further, the distance d may lie in a range between about 70 μm and 220 μm.

Figures 2, 3:
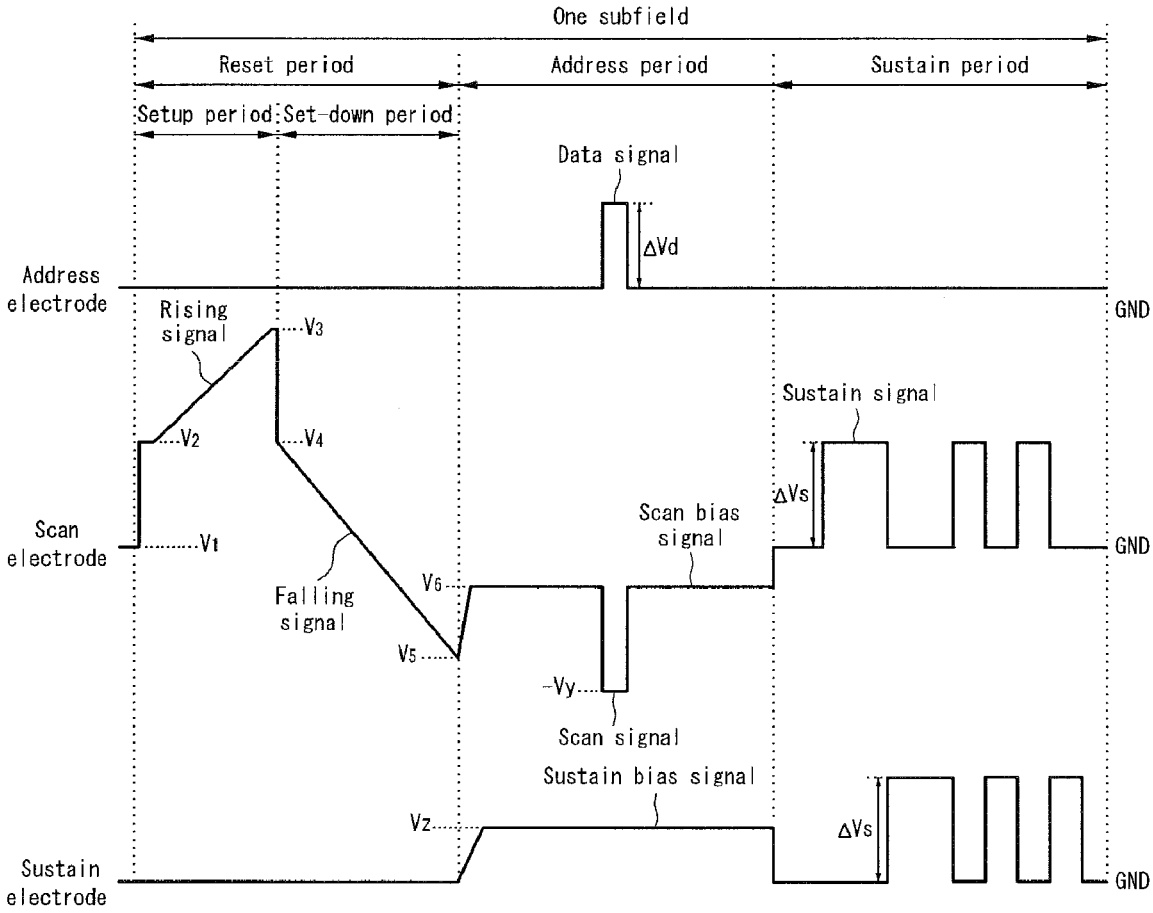
FIG. 2 illustrates an operation of the plasma display panel according to the exemplary embodiment.
FIG. 3 is a table showing a composition of a phosphor layer.

FIG. 2 illustrates an operation of the plasma display panel according to the exemplary embodiment. The exemplary embodiment is not limited to the operation shown in FIG. 2, and a method for operating the plasma display panel may be variously changed.

As shown in FIG. 2, during a reset period for initialization of wall charges, a reset signal is supplied to the scan electrode. The reset signal includes a rising signal and a falling signal. The reset period is further divided into a setup period and a set-down period.

During the setup period, the rising signal is supplied to the scan electrode. The rising signal sharply rises from a first voltage V1 to a second voltage V2, and then gradually rises from the second voltage V2 to a third voltage V3. The first voltage V1 may be a ground level voltage GND.

The rising signal generates a weak dark discharge (i.e., a setup discharge) inside the discharge cell during the setup period, thereby accumulating a proper amount of wall charges inside the discharge cell.

During the set-down period, a falling signal of a polarity opposite a polarity of the rising signal is supplied to the scan electrode. The falling signal gradually falls from a fourth voltage V4 lower than a peak voltage (i.e., the third voltage V3) of the rising signal to a fifth voltage V5.

The falling signal generates a weak erase discharge (i.e., a set-down discharge) inside the discharge cell. Furthermore, the remaining wall charges are uniform inside the discharge cells to the extent that an address discharge can be stably performed.

During an address period following the reset period, a scan bias signal, which is maintained at a sixth voltage V6 higher than a lowest voltage (i.e., the fifth voltage V5) of the falling signal, is supplied to the scan electrode. A scan signal, which falls from the scan bias signal to a scan voltage −Vy, is supplied to the scan electrode.

A width of a scan signal supplied during an address period of at least one subfield may be different from a width of a scan signal supplied during address periods of the other subfields. For instance, a width of a scan signal in a subfield may be larger than a width of a scan signal in the next subfield in time order. Further, a width of the scan signal may be gradually reduced in the order of 2.6 μs, 2.3 μs, 2.1 μs, 1.9 s, etc., or in the order of 2.6 μs, 2.3 μs, 2.3 μs, 2.1 μs, . . . , 1.9 μs, 1.9 μs, etc.

As above, when the scan signal is supplied to the scan electrode, a data signal corresponding to the scan signal is supplied to the address electrode. The data signal rises from a ground level voltage GND by a data voltage magnitude ΔVd.

As the voltage difference between the scan signal and the data signal is added to the wall voltage generated during the reset period, the address discharge occurs within the discharge cell to which the data signal is supplied.

A sustain bias signal is supplied to the sustain electrode during the address period to prevent the address discharge from unstably occurring by interference of the sustain electrode Z.

The sustain bias signal is substantially maintained at a sustain bias voltage Vz. The sustain bias voltage Vz is lower than a voltage Vs of a sustain signal and is higher than the ground level voltage GND.

During a sustain period following the address period, a sustain signal is alternately supplied to the scan electrode and the sustain electrode. The sustain signal has a voltage magnitude corresponding to the sustain voltage Vs.

As the wall voltage within the discharge cell selected by performing the address discharge is added to the sustain voltage Vs of the sustain signal, every time the sustain signal is supplied, the sustain discharge, i.e., a display discharge occurs between the scan electrode and the sustain electrode.

A plurality of sustain signals are supplied during a sustain period of at least one subfield, and a width of at least one of the plurality of sustain signals may be different from widths of the other sustain signals. For instance, a width of a first supplied sustain signal among the plurality of sustain signals may be larger than widths of the other sustain signals. Hence, a sustain discharge can be more stable.

FIG. 3 is a table showing a composition of a phosphor layer.

As shown in FIG. 3, a first phosphor layer emitting red light includes a first phosphor material having a white-based color and a red pigment.

The first phosphor material is not particularly limited except the red light emission. The first phosphor material may be (Y, Gd)BO:Eu in consideration of an emitting efficiency of red light.

The red pigment has a red-based color. The first phosphor layer may have a red-based color by mixing the red pigment with the first phosphor material. The red pigment is not particularly limited except the red-based color. The red pigment may include an iron (Fe)-based material in consideration of facility of powder manufacture, color, and manufacturing cost.

The Fe-based material may exist in a state of iron oxide in the first phosphor layer. For instance, the Fe-based material may exist in a state of $\alpha Fe_2O_3$ in the first phosphor layer.

A second phosphor layer emitting blue light includes a second phosphor material having a white-based color and a blue pigment.

The second phosphor material is not particularly limited except the blue light emission. The second phosphor material may be (Ba, Sr, Eu)$MgAl_{10}O_{17}$ in consideration of an emitting efficiency of blue light.

The blue pigment has a blue-based color. The second phosphor layer may have a blue-based color by mixing the blue pigment with the second phosphor material. The blue pigment is not particularly limited except the blue-based color. The blue pigment may include at least one of a cobalt (Co)-based material, a copper (Cu)-based material, a chrome (Cr)-based material or a nickel (Ni)-based material in consideration of facility of powder manufacture, color, and manufacturing cost.

At least one of the Co-based material, the Cu-based material, the Cr-based material or the Ni-based material may exist in a state of metal oxide in the second phosphor layer. For instance, the Co-based material may exist in a state of $CoAl_2O_4$ in the second phosphor layer.

A third phosphor layer emitting green light includes a third phosphor material having a white-based color, and may not include a pigment.

The third phosphor material is not particularly limited except the green light emission. The third phosphor material may include $Zn_2SiO_4:Mn^{+2}$ and $YBO_3:Tb^{+3}$ in consideration of an emitting efficiency of green light.

Figure 4A:
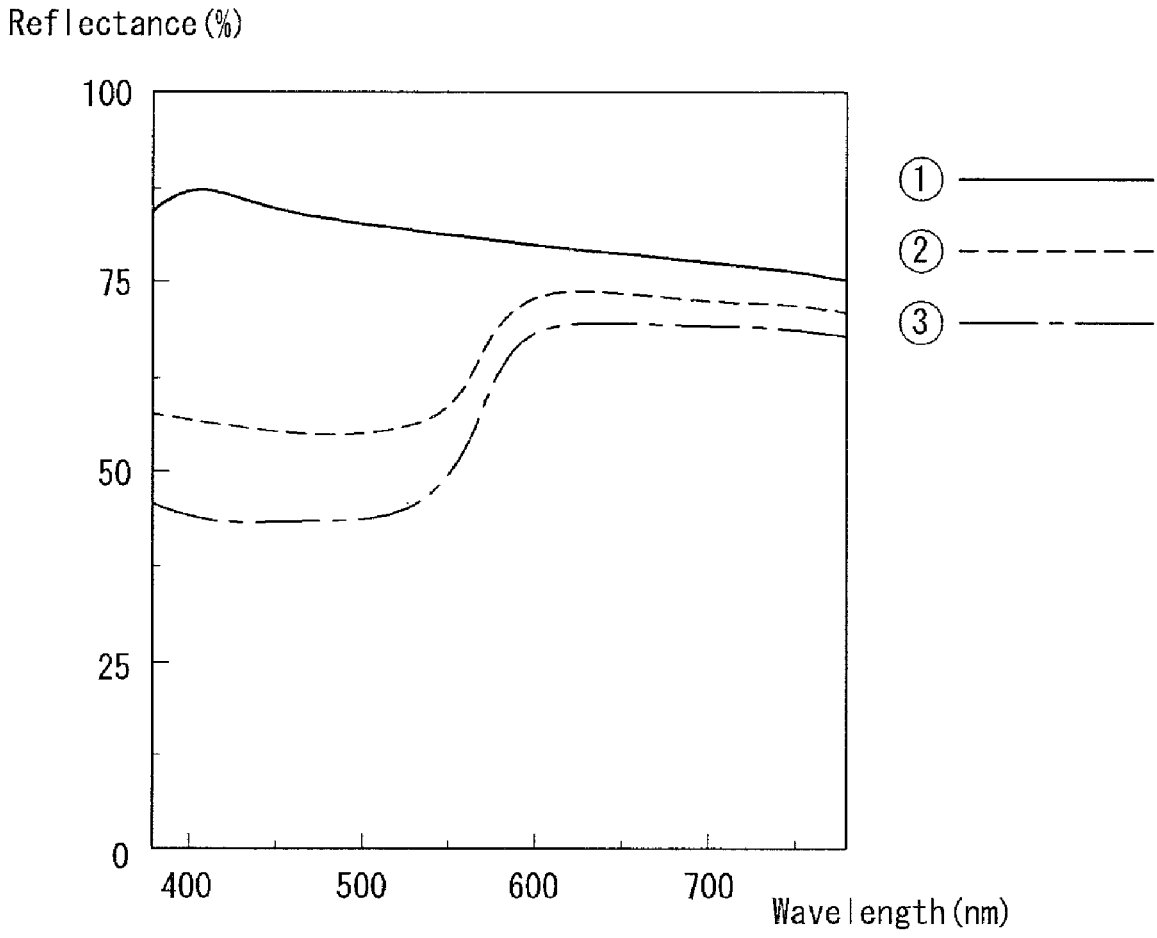
FIGS. 4A and 4B are graphs showing reflectances depending on compositions of first and second phosphor layers, respectively.
Figure 4B:
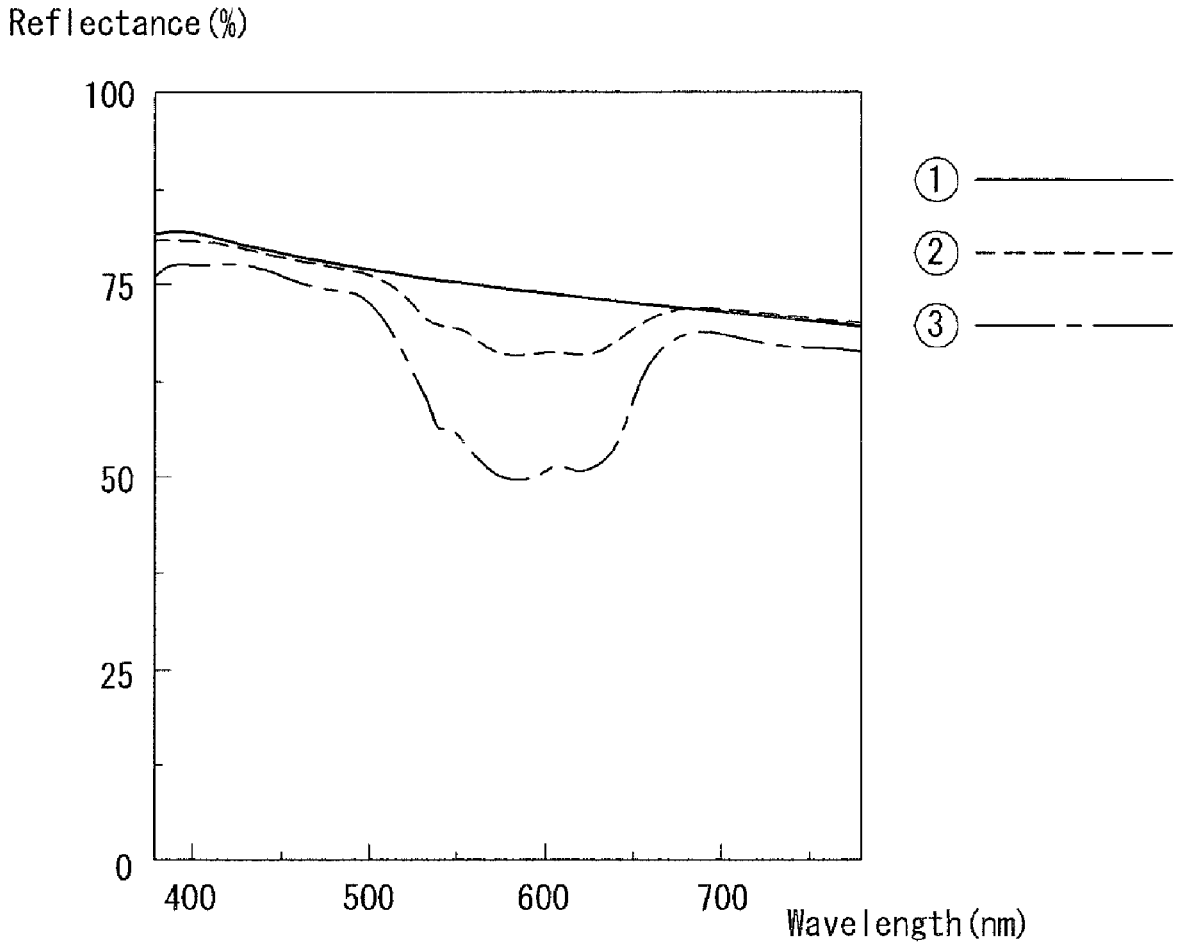

FIGS. 4A and 4B are graphs showing reflectances depending on compositions of first and second phosphor layers, respectively.

First, a 7-inch test model on which a first phosphor layer emitting red light from all discharge cells is formed is manufactured. Then, light is directly irradiated on a barrier rib and the first phosphor layer of the test model in a state where a front substrate of the test model is removed to measure a reflectance of the test model.

The first phosphor layer includes a first phosphor material and a red pigment. The first phosphor material is (Y, Gd)BO:Eu. The red pigment is an Fe-based material, and the Fe-based material in a state of $\alpha Fe_2O_3$ is mixed with the first phosphor material.

In FIG. 4A, ① indicates a case where the first phosphor layer does not include the red pigment. ② indicates a case where the first phosphor layer includes the red pigment of 0.1 part by weight. ③ indicates a case where the first phosphor layer includes the red pigment of 0.5 part by weight.

In case of ① not including the red pigment, a reflectance is equal to or more than about 75% at a wavelength of 400 nm to 750 nm. Because the first phosphor material having a white-based color reflects most of incident light, the reflectance in ① is high.

In case of ② including the red pigment of 0.1 part by weight, a reflectance is equal to or less than about 60% at a wavelength of 400 nm to 550 nm and ranges from about 60% to 75% at a wavelength more than 550 nm.

In case of ③ including the red pigment of 0.5 part by weight, a reflectance is equal to or less than about 50% at a wavelength of 400 nm to 550 nm and ranges from about 50% to 70% at a wavelength more than 550 nm.

Because the red pigment having a red-based color absorbs incident light, the reflectances in ② and ③ are less than the reflectance in ①.

FIG. 4B is a graph showing a reflectance of a test module depending on a wavelength. First, a 7-inch test model on which a second phosphor layer emitting blue light from all discharge cells is formed is manufactured. Then, light is directly irradiated on a barrier rib and the second phosphor layer of the test model in a state where a front substrate of the test model is removed to measure a reflectance of the test model.

The second phosphor layer includes a second phosphor material and a blue pigment. The second phosphor material is (Ba, Sr, Eu)$MgAl_{10}O_{17}$. The blue pigment is a Co-based material, and the Co-based material in a state of $CoAl_2O_4$ is mixed with the second phosphor material.

In FIG. 4B, ① indicates a case where the second phosphor layer does not include the blue pigment. ② indicates a case where the second phosphor layer includes the blue pigment of 0.1 part by weight. ③ indicates a case where the second phosphor layer includes the blue pigment of 1.0 part by weight.

In case of ① not including the blue pigment, a reflectance is equal to or more than about 72% at a wavelength of 400 nm to 750 nm. Because the second phosphor material having a white-based color reflects most of incident light, the reflectance in ① is high.

In case of ② including the blue pigment of 0.1 part by weight, a reflectance is equal to or more than about 74% at a wavelength of 400 nm rises to about 72% at a wavelength more than 650 nm.

In case of ③ including the blue pigment of 1.0 part by weight, a reflectance is at least 50% at a wavelength of 510 nm to 650 nm.

Because the blue pigment having a blue-based color absorbs incident light, the reflectances in ② and ③ are less than the reflectance in ①. A reduction in the reflectance can improve the contrast characteristic, and thus the image quality can be improved.

Figure 5A:
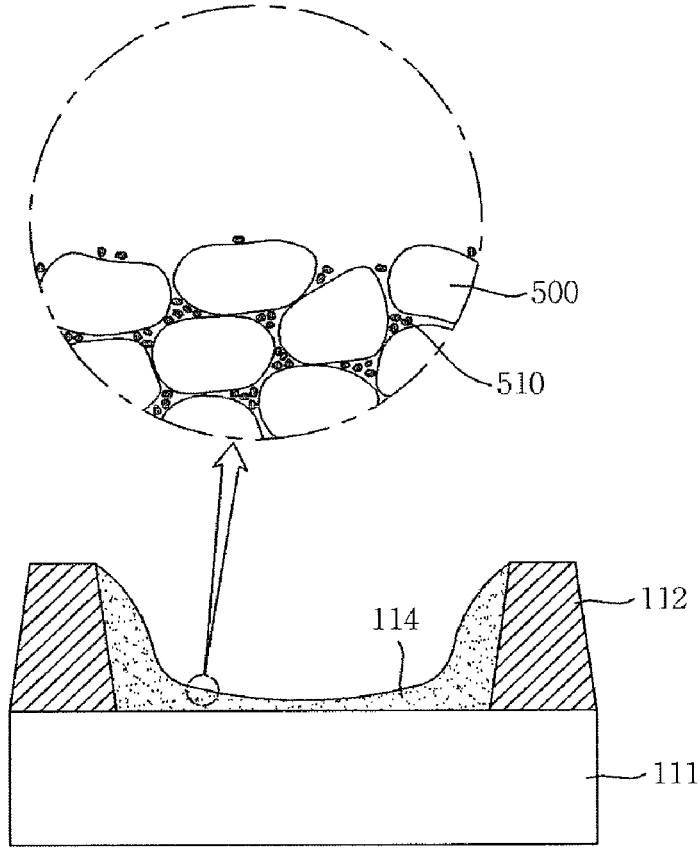
FIGS. 5A and 5B are diagrams for explaining a distribution characteristic of pigment particles depending on the size of phosphor particles.
Figure 5B:
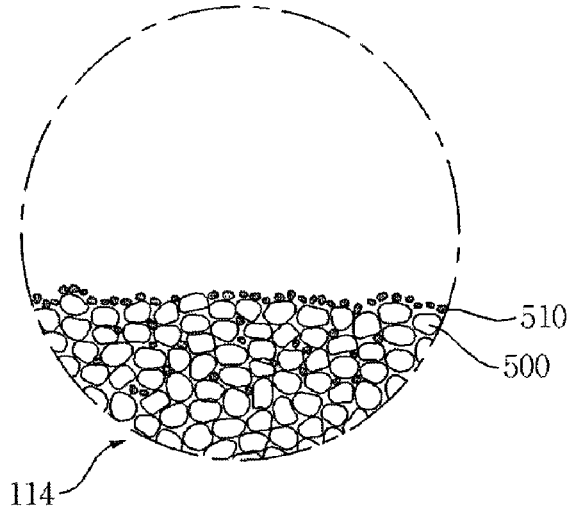

FIGS. 5A and 5B are diagrams for explaining a distribution characteristic of pigment particles depending on the size of phosphor particles.

As shown in FIG. 5A, in case the size of phosphor particles 500 is relatively large, a relatively wide space is provided between the phosphor particles 500.

Pigment particles 510 mixed with the phosphor particles 500 may be positioned between the phosphor particles 500 in the relatively wide space. An area of the surface of the phosphor layer 114 which the pigment particles 510 occupy may decrease, and thus the reflectance may increase.

On the other hand, as shown in FIG. 5B, in case the size of the phosphor particles 500 is relatively small, the plurality of pigment particles 510 may be positioned on the surface of the phosphor layer 114 even if the pigment particle 510 of the same content and the same size as the pigment particle 510 of FIG. 5A are used. Accordingly, the reflectance can be sufficiently reduced.

Considering the description of FIGS. 5A and 5B, as the size of the phosphor particles 500 increases, a content of the pigment increases so as to sufficiently reduce the reflectance.

FIG. 6 is a diagram for explaining a relationship between the size of a first phosphor particle and a content of a red pigment.

More specifically, FIG. 6 is a graph showing a reflectance and a luminance depending on changes in a ratio C1/L1 of a content C1 of the red pigment to an average particle size L1 of particles of the first phosphor material. The average particle size L1 is measured in units of micrometer (μm), and the content C1 of the red pigment is measured in units of parts by weight.

While the ratio C1/L1 ranges from 0.001 to 8.0, the reflectance and the luminance of the displayed image are measured. In this case, particles of the red pigment have the substantially equal size.

In FIG. 6, ◎ indicates an excellent state in which the reflectance is sufficiently low or the luminance is sufficiently high, ○ indicates a good state, and X indicates a bad state in which the reflectance is excessively high or the luminance is excessively low.

As shown in FIG. 6, when the ratio C1/L1 is 0.001 to 0.003, the reflectance is bad (X). Because the average particle size L1 of the first phosphor material is excessively larger than the content C1 of the red pigment, the most particles of the red pigment are positioned between the particles of the first phosphor material. Hence, the reflectance of the first phosphor may be excessively low and the contrast characteristic may worse. For example, supposing that the content C1 of the red pigment is 0.1 part by weight, the average particle size L1 of the first phosphor material has an excessively large value between 34 μm and 100 μm.

On the other hand, when the ratio C1/L1 is 0.005 to 0.007, the reflectance is good (○). In this case, because the reflectance is low, the contrast characteristic may be reduced. However, a reduction width of the contrast characteristic is small.

When the ratio C1/L1 is equal to or larger than 0.01, the reflectance is excellent (◎). Because the average particle size L1 of the first phosphor material is sufficiently smaller than the content C1 of the red pigment, the reflectance of the first phosphor layer is sufficiently high because of the reason described in FIG. 5B.

When the ratio C1/L1 is 0.001 to 3.0, the luminance is excellent (◎). Because the average particle size L1 of the first phosphor material is sufficiently larger than the content C1 of the red pigment, the most particles of the red pigment are positioned between the particles of the first phosphor material, and thus an area of the surface of the first phosphor layer which the red pigment occupies may be sufficiently small.

When the ratio C1/L1 is 5.1 to 6.0, the luminance is good (○). In this case, because the luminance is low, a viewer may perceive that a displayed image is dark. However, a dark level of the displayed image is small.

When the ratio C1/L1 is equal to or larger than 8.0, the luminance is bad (X). Because the average particle size L1 of the first phosphor material is excessively smaller than the content C1 of the red pigment, the area of the surface of the first phosphor layer covered by the red pigment is excessively wide. For example, supposing that the content C1 of the red pigment is 2 parts by weight, the average particle size L1 of the first phosphor material is an excessively small value of about 0.25 μm.

Considering the table of FIG. 6, the content C1 of the red pigment may satisfy the following equation 1.

$$0.005 \leqq C1/L1 \leqq 6 \quad \text{[Equation 1]}$$

Furthermore, the content C1 of the red pigment may satisfy the following equation 2.

$$0.01 \leqq C1/L1 \leqq 3 \quad \text{[Equation 2]}$$

FIG. 7 is a diagram for explaining a relationship between the size of a second phosphor particle and a content of a blue pigment.

More specifically, FIG. 7 is a graph showing a reflectance and a luminance depending on changes in a ratio C2/L2 of a content C2 of the blue pigment to an average particle size L2 of particles of the second phosphor material. The average particle size L2 is measured in units of micrometer (μm), and the content C2 of the blue pigment is measured in units of parts by weight.

While the ratio C2/L2 ranges from 0.005 to 10.0, the reflectance and the luminance of the displayed image are measured. In this case, particles of the blue pigment have the substantially equal size.

In FIG. 7, ◎ indicates an excellent state in which the reflectance is sufficiently low or the luminance is sufficiently high, ○ indicates a good state, and X indicates a bad state in which the reflectance is excessively high or the luminance is excessively low.

As shown in FIG. 7, when the ratio C2/L2 is 0.005, the reflectance is bad (X). Because the average particle size L2 of the second phosphor material is excessively larger than the content C2 of the blue pigment, the most particles of the blue pigment are positioned between the particles of the second phosphor material. Hence, the reflectance of the second phosphor may be excessively low, and the contrast characteristic may worse.

On the other hand, when the ratio C2/L2 is 0.01 to 0.03, the reflectance is good (○). In this case, because the reflectance is low, the contrast characteristic may be reduced. However, a reduction width of the contrast characteristic is small.

When the ratio C2/L2 is equal to or larger than 0.05, the reflectance is excellent (◎). Because the average particle size L2 of the second phosphor material is sufficiently smaller than the content C2 of the blue pigment, the reflectance of the second phosphor layer is sufficiently high because of the reason described in FIG. 5B.

When the ratio C2/L2 is 0.005 to 4.0, the luminance is excellent (◎). Because the average particle size L2 of the second phosphor material is sufficiently larger than the content C2 of the blue pigment, the most particles of the blue pigment are positioned between the particles of the second phosphor material, and thus an area of the surface of the second phosphor layer which the blue pigment occupies may be sufficiently small.

When the ratio C2/L2 is 4.2 to 8.0, the luminance is good (○). In this case, because the luminance is low, the viewer may perceive that a displayed image is dark. However, a dark level of the displayed image is small.

When the ratio C2/L2 is equal to or larger than 10.0, the luminance is bad (X). Because the average particle size L2 of the second phosphor material is excessively smaller than the content C2 of the blue pigment, the area of the surface of the second phosphor layer covered by the blue pigment is excessively wide.

Considering the table of FIG. 7, the content C2 of the blue pigment may satisfy the following equation 3.

$$0.01 \leqq C2/L2 \leqq 8 \quad \text{[Equation 3]}$$

Furthermore, the content C2 of the blue pigment may satisfy the following equation 4.

$$0.05 \leqq C2/L2 \leqq 4 \quad \text{[Equation 4]}$$

Figure 8:
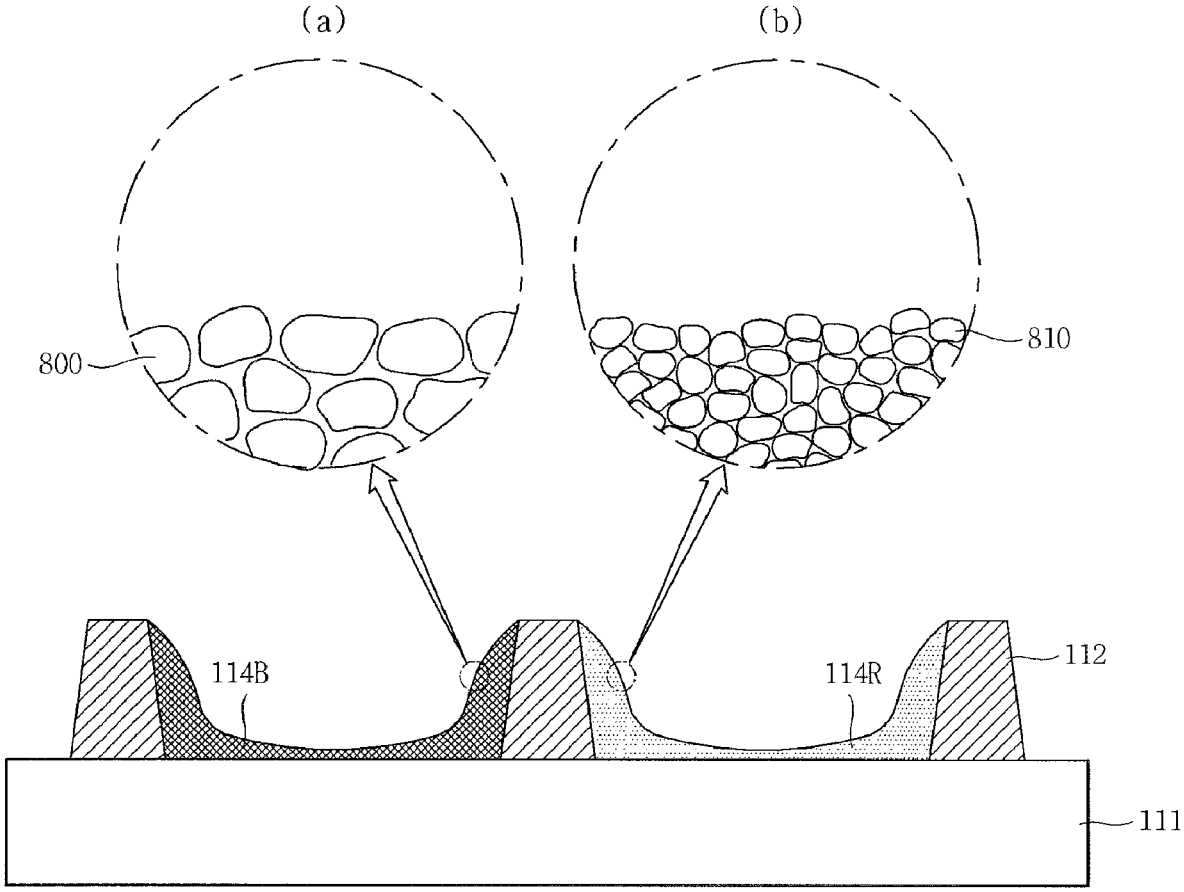
FIG. 8 is a diagram for explaining a difference between a content of a red pigment and a content of a blue pigment.

FIG. 8 is a diagram for explaining a difference between a content of a red pigment and a content of a blue pigment.

As shown in FIG. 8, (a) shows particles 800 of a second phosphor material constituting a second phosphor layer 114B, and (b) shows particles 810 of a first phosphor material constituting a first phosphor layer 114R.

The size of the second phosphor particles 800 is larger than the size of the first phosphor material particles 810.

A reason why the size of the second phosphor particles 800 is larger than the size of the first phosphor material particles 810 may be caused by a difference between a composition of the second phosphor material and a composition of the first phosphor material and a difference between a processing process of the second phosphor material and a processing process of the first phosphor material.

As described above, in case the size of the phosphor particles increases, a content of the pigment has to increase. As a result, the reflectance can be reduced, and the contrast characteristic can be improved.

Accordingly, because the size of the second phosphor particles 800 is larger than the size of the first phosphor material particles 810, a content of a blue pigment constituting the second phosphor layer 114B is more than a content of a red pigment constituting the first phosphor layer 114R.

Figure 9:
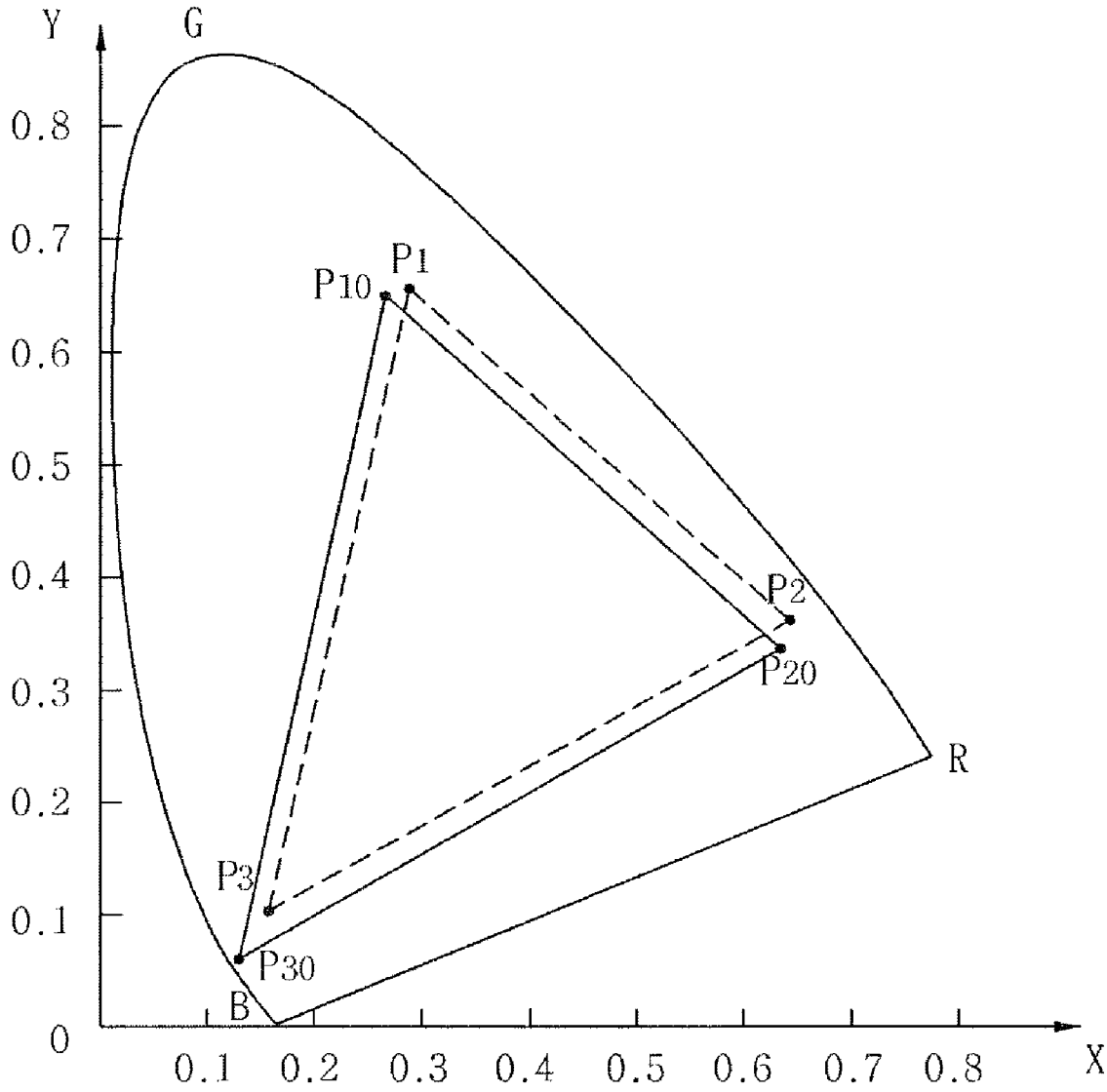
FIG. 9 shows a color coordinate characteristic of the plasma display panel.

FIG. 9 shows a color coordinate characteristic of each of an A-type panel in which a content of a blue pigment constituting a second phosphor layer is more than a content of a red pigment constituting a first phosphor layer, and a B-type panel in which a content of a blue pigment constituting a second phosphor layer is equal to or less than a content of a red pigment constituting a first phosphor layer.

For example, the A-type panel including the blue pigment of 1 part by weight and the red pigment of 0.2 part by weight and the B-type panel including the blue pigment of 0.1 part by weight and the red pigment of 0.3 part by weight were manufactured, and then color coordinates of the A-type and B-type panels were measured using MCPD-1000 in a state where the same driving signal is supplied to the A-type and B-type panels.

As shown in FIG. 9, in the B-type panel, a green coordinate P1 has X-axis coordinate of about 0.276 and Y-axis coordinate of about 0.660, a red coordinate P2 has X-axis coordinate of about 0.642 and Y-axis coordinate of about 0.368, and a blue coordinate P3 has X-axis coordinate of about 0.158 and Y-axis coordinate of about 0.103.

In the A-type panel, a green coordinate P10 has X-axis coordinate of about 0.275 and Y-axis coordinate of about 0.655, a red coordinate P20 has X-axis coordinate of about 0.635 and Y-axis coordinate of about 0.337, and a blue coordinate P30 has X-axis coordinate of about 0.130 and Y-axis coordinate of about 0.060.

Because the content of the red pigment is more than the content of the blue pigment in the B-type panel, the most particles of the blue pigment are positioned between particles of the second phosphor material having the relatively large size in the second phosphor layer as shown in FIG. 5A, and the most particles of the red pigment are positioned on the surface of the first phosphor layer as shown in FIG. 5B. Hence, because the viewer visually perceives the red pigment, the viewer may perceive that the displayed image is close to red. This case means that the color temperature is relatively low.

On the other hand, because the content of the blue pigment mixed with the second phosphor material having the relatively large particle size is more than the content of the red pigment in the A-type panel, the viewer can perceive both the blue pigment and the red pigment. Accordingly, a sharp reduction in the color temperature can be prevented.

It can be seen from FIG. 9 that a triangle connecting the three coordinates P10, P20 and P30 of the A-type panel further moves in a blue direction as compared with a triangle connecting the three coordinates P1, P2 and P3 of the B-type panel. This means that the color temperature of the A-type panel is higher than the color temperature of the B-type panel. Accordingly, the viewer may think that an image displayed on the A-type panel is clearer than an imaged displayed on the B-type panel.

Figure 10A:
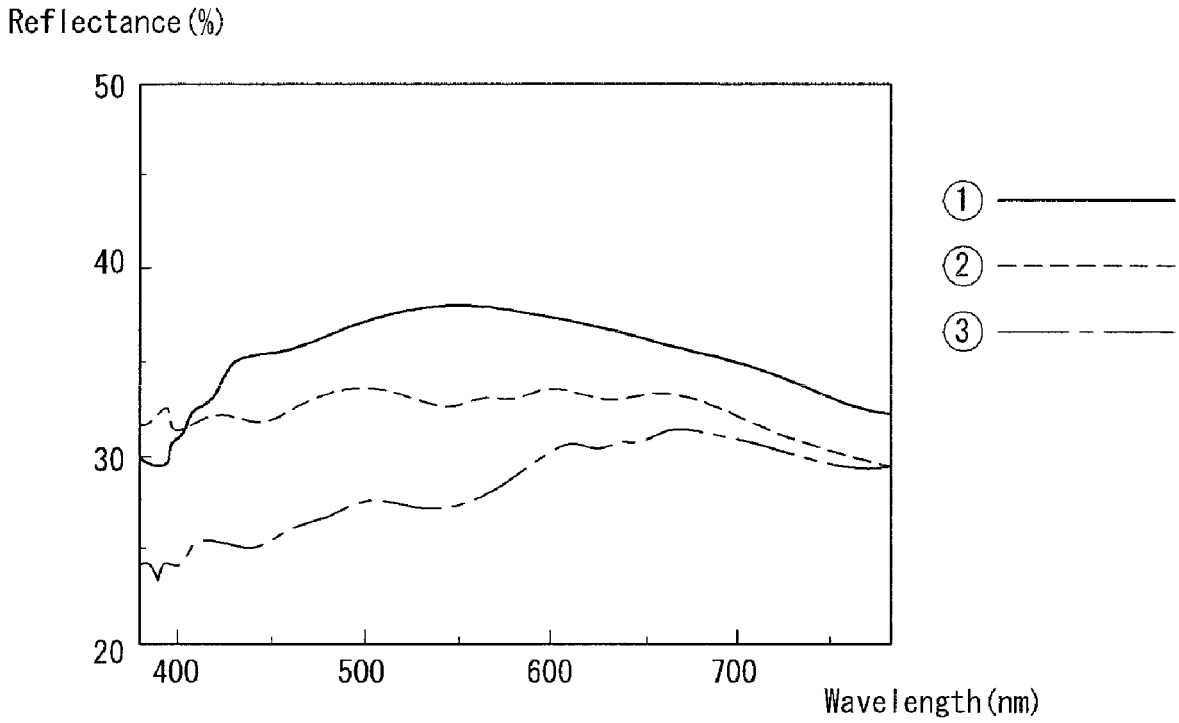
FIGS. 10A and 10B are graphs showing a reflectance and a luminance of a plasma display panel depending on changes in a content of a red pigment, respectively.
Figure 10B:
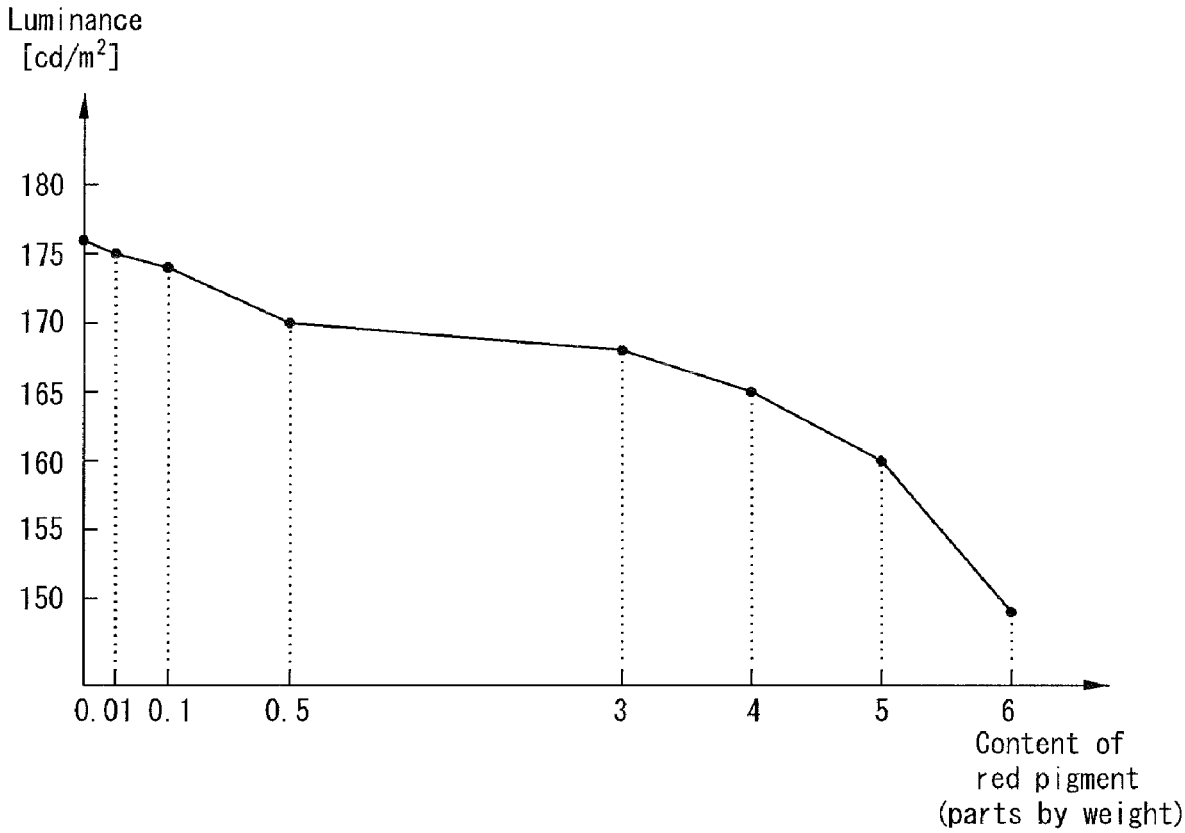

FIGS. 10A and 10B are graphs showing a reflectance and a luminance of a plasma display panel depending on changes in a content of a red pigment, respectively.

In FIGS. 10A and 10B, the first phosphor layer is positioned inside the red discharge cell, the second phosphor layer is positioned inside the blue discharge cell, and the third phosphor layer is positioned inside the green discharge cell. Further, a reflectance and a luminance of the plasma display panel are measured depending on changes in a content of the red pigment mixed with the first phosphor layer in a state where the blue pigment of 1.0 part by weight is mixed with the second phosphor layer. In this case, the reflectance and the luminance of the plasma display panel are measured in a panel state in which the front substrate and the rear substrate coalesce with each other.

The first phosphor material is (Y, Gd)BO:Eu. The red pigment is an Fe-based material, and the Fe-based material in a state of $\alpha Fe_2O_3$ is mixed with the first phosphor material.

The second phosphor material is (Ba, Sr, Eu)$MgAl_{10}O_{17}$. The blue pigment is a Co-based material, and the Co-based material in a state of $CoAl_2O_4$ is mixed with the second phosphor material.

In FIG. 10A, ① indicates a case where the first phosphor layer does not include the red pigment in a state where the second phosphor layer includes the blue pigment of 1.0 part by weight. ② indicates a case where the first phosphor layer includes the red pigment of 0.1 part by weight in a state where the second phosphor layer includes the blue pigment of 1.0 part by weight. ③ indicates a case where the first phosphor layer includes the red pigment of 0.5 part by weight in a state where the second phosphor layer includes the blue pigment of 1.0 part by weight.

In case of ① not including the red pigment, a panel reflectance rises from about 33% to 38% at a wavelength of 400 nm to 550 nm. The panel reflectance falls to about 33% at a wavelength more than 550 nm. In other words, the panel reflectance has a high value of about 37% to 38% at a wavelength of 500 nm to 600 nm.

Because the first phosphor material having a white-based color reflects most of incident light, the panel reflectance in ① is relatively high although the blue pigment is mixed with the second phosphor layer.

In case of ② including the red pigment of 0.1 part by weight, a panel reflectance is equal to or less than about 34% at a wavelength of 400 nm to 750 nm, and has a relatively small value of about 33% to 34% at a wavelength of 500 nm to 600 nm.

In case of ③ including the red pigment of 0.5 part by weight, a panel reflectance ranges from about 24% to 31.5% at a wavelength of 400 nm to 650 nm and falls to about 30% at a wavelength of 650 nm to 750 nm. Further, the panel reflectance has a relatively small value of about 27.5% to 29.5% at a wavelength of 500 nm to 600 nm.

As above, as a content of the red pigment increases, the panel reflectance decreases.

There is a relatively great difference between the panel reflectance in ① not including the red pigment and the panel reflectances in ② and ③ including the red pigment at a wavelength of 500 nm to 600 nm, for instance, at a wavelength of 550 nm.

Because a wavelength of 500 nm to 600 nm is mainly seen as red, orange and yellow light in visible light, the high panel reflectance at a wavelength of 500 nm to 600 nm means that a displayed image is close to red. In this case, because a color temperature is relatively low, the viewer may easily feel eyestrain and may feel that the image is not clear.

On the other hand, the low panel reflectance at a wavelength of 500 nm to 600 nm means that absorptance of red, orange and yellow light is high. Hence, a color temperature of a displayed image is relatively high, and thus an image can be clearer.

Accordingly, the relatively great difference between the panel reflectance in ① and the panel reflectance in ② and ③ at a wavelength of 500 nm to 600 nm means that an excessive reduction in the color temperature can be prevented although the red pigment is mixed with the first phosphor layer. Hence, the viewer can watch a clearer image.

Considering this, the color temperature of the panel can be improved by setting the panel reflectance to be equal to or less than 30% at a wavelength of 500 nm to 600 nm, for instance, at a wavelength of 550 nm.

FIG. 10B is a graph showing a luminance of the same image depending on changes in a content of the red pigment included in the first phosphor layer in a state where a content of the blue pigment included in the second phosphor layer is fixed.

As shown in FIG. 10B, a luminance of an image displayed when the first phosphor layer does not include the red pigment is about 176 cd/m$^2$.

When a content of the red pigment is 0.01 part by weight, the luminance of the image is reduced to about 175 cd/m$^2$. The red pigment can reduce the luminance of the image, because particles of the red pigment cover a portion of the particle surface of the first phosphor material and thus hinder ultraviolet rays generated by a discharge inside the discharge cell from being irradiated on the particles of the first phosphor material.

When a content of the red pigment ranges from 0.1 to 3 parts by weight, a luminance of the image ranges from about 168 cd/m$^2$ to 174 cd/m$^2$.

When a content of the red pigment ranges from 3 to 5 parts by weight, a luminance of the image ranges from about 160 cd/m$^2$ to 168 cd/m$^2$.

When a content of the red pigment is equal to or more than 6 parts by weight, a luminance of the image is sharply reduced to a value equal to or less than about 149 cd/m$^2$. In other words, when a large amount of the red pigment is mixed, the particles of the red pigment cover a large area of the particle surface of the first phosphor material and thus the luminance is sharply reduced.

Considering the graphs of FIGS. 10A and 10B, when a content of the red pigment ranges from 0.01 to 5 parts by weight, a reduction in the luminance can be prevented while the panel reflectance is reduced. A content of the red pigment may range from 0.1 to 3 parts by weight.

Figure 11A:
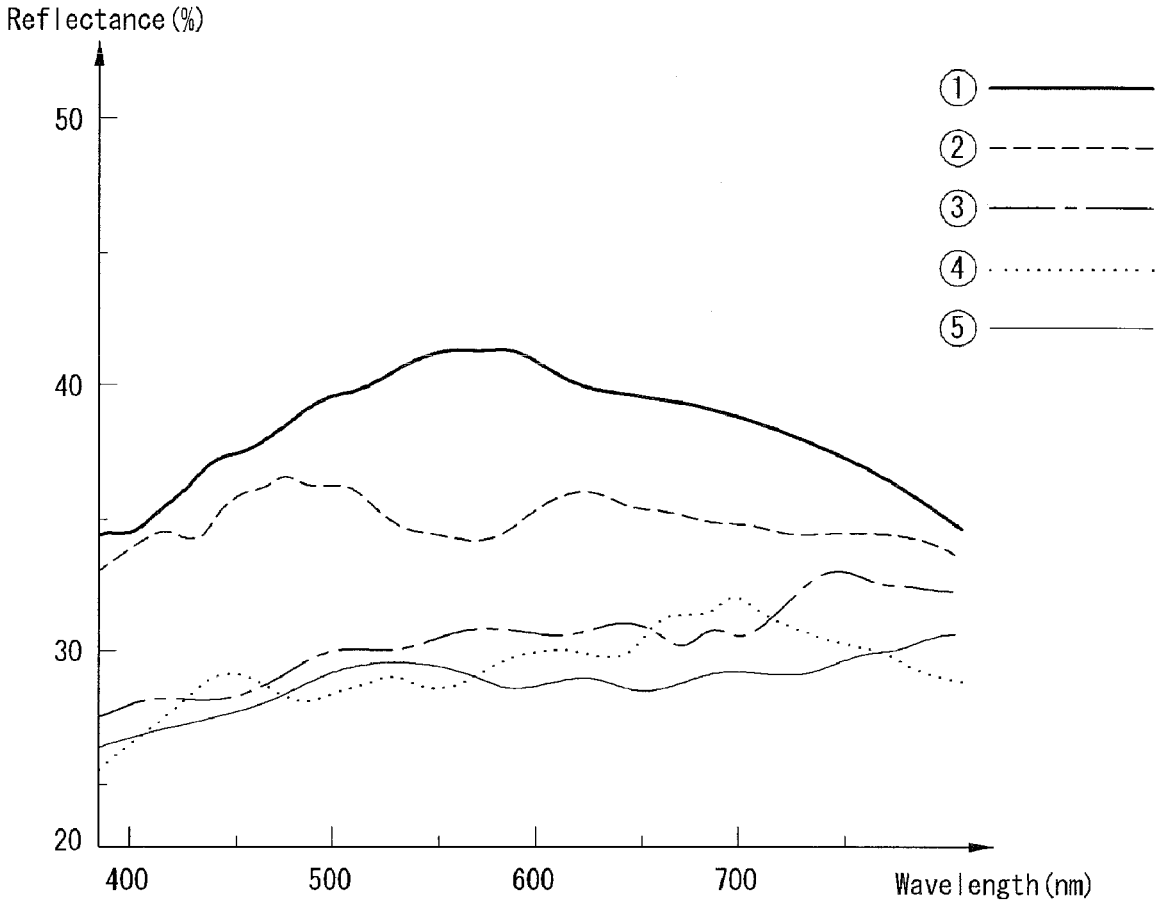
FIGS. 11A and 11B are graphs showing a reflectance and a luminance of a plasma display panel depending on changes in a content of a blue pigment, respectively.
Figure 11B:
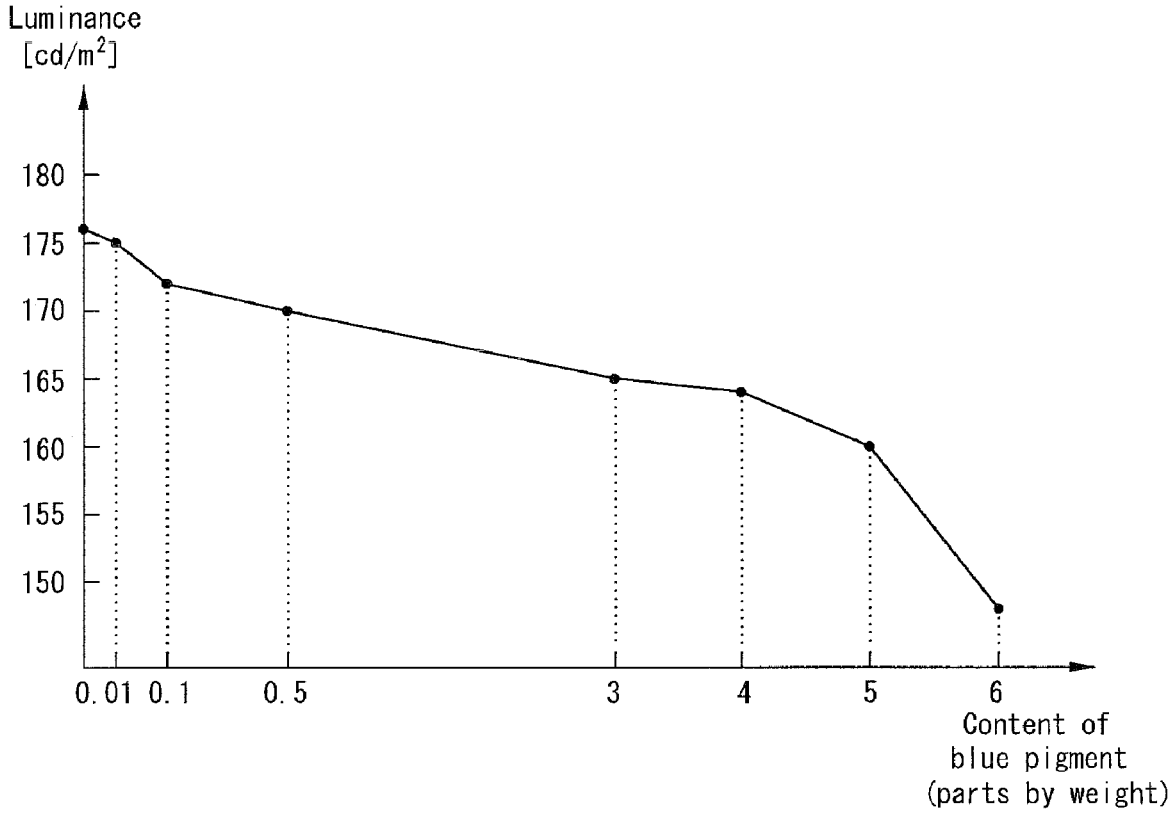

FIGS. 11A and 11B are graphs showing a reflectance and a luminance of a plasma display panel depending on changes in a content of a blue pigment, respectively. A description of FIGS. 11A and 11B overlapping the description of FIGS. 10A and 10B is briefly made or entirely omitted.

In FIGS. 11A and 11B, the first phosphor layer is positioned inside the red discharge cell, the second phosphor layer is positioned inside the blue discharge cell, and the third phosphor layer is positioned inside the green discharge cell. Further, a reflectance and a luminance of the plasma display panel are measured depending on changes in a content of the blue pigment mixed with the second phosphor layer in a state where the red pigment of 0.2 part by weight is mixed with the first phosphor layer. In this case, the reflectance and the luminance of the plasma display panel are measured in a panel state in which the front substrate and the rear substrate coalesce with each other.

The other experimental conditions in FIGS. 11A and 11B are substantially the same as the experimental conditions in FIGS. 10A and 10B.

In FIG. 11A, ① indicates a case where the second phosphor layer does not include the blue pigment in a state where the first phosphor layer includes the red pigment of 0.2 part by weight. ② indicates a case where the second phosphor layer includes the blue pigment of 0.1 part by weight in a state where the first phosphor layer includes the red pigment of 0.2 part by weight. ③ indicates a case where the second phosphor layer includes the blue pigment of 0.5 part by weight in a state where the first phosphor layer includes the red pigment of 0.2 part by weight. ④ indicates a case where the second phosphor layer includes the blue pigment of 3 parts by weight in a state where the first phosphor layer includes the red pigment of 0.2 part by weight. ⑤ indicates a case where the state where the first phosphor layer includes the red pigment of 0.2 part by weight.

In case of ① not including the blue pigment, a panel reflectance rises from about 35% to 40.5% at a wavelength of 400 nm to 550 nm. The panel reflectance falls to about 35.5% at a wavelength more than 550 nm. In other words, the panel reflectance has a high value of about 39% to 40.5% at a wavelength of 500 nm to 600 nm.

Because the second phosphor material having a white-based color reflects most of incident light, the panel reflectance in ① is relatively high although the red pigment is mixed with the first phosphor layer.

In case of ② including the blue pigment of 0.1 part by weight, a panel reflectance is equal to or less than about 38% at a wavelength of 400 nm to 750 nm, and has a relatively small value of about 34% to 37% at a wavelength of 500 nm to 600 nm.

In case of ③ including the blue pigment of 0.5 part by weight, a panel reflectance ranges from about 26% to 29% at a wavelength of 400 nm to 650 nm and falls from about 28% to 32.5% at a wavelength of 650 nm to 750 nm. Further, the panel reflectance has a relatively small value of about 28% to 29% at a wavelength of 500 nm to 600 nm.

In case of ④ including the blue pigment of 3 parts by weight, a panel reflectance ranges from about 22.5% to 29% at a wavelength of 400 nm to 650 nm and ranges from about 29% to 3% at a wavelength of 650 nm to 750 nm. Further, the panel reflectance has a relatively small value of about 26.5% to 28% at a wavelength of 500 nm to 600 nm.

In case of ⑤ including the blue pigment of 7 parts by weight, a panel reflectance ranges from about 25% to 28% at a wavelength of 400 nm to 700 nm and ranges from about 28% to 30% at a wavelength more than 700 nm.

FIG. 11B is a graph showing a luminance of the same image depending on changes in a content of the blue pigment included in the second phosphor layer in a state where a content of the red pigment included in the first phosphor layer is fixed.

As shown in FIG. 11B, a luminance of an image displayed when the second phosphor layer does not include the blue pigment is about 176 cd/m$^2$.

When a content of the blue pigment is 0.01 part by weight, a luminance of the image is about 175 cd/m$^2$.

When a content of the blue pigment is 0.1 part by weight, a luminance of the image is about 172 cd/m$^2$.

When a content of the blue pigment ranges from 0.5 to 4 parts by weight, a luminance of the image has a stable value of about 164 cd/m$^2$ to 170 cd/m$^2$.

When a content of the blue pigment ranges from 4 to 5 parts by weight, a luminance of the image ranges from about 160 cd/m$^2$ to 164 cd/m$^2$.

When a content of the blue pigment exceeds 6 parts by weight, a luminance of the image is sharply reduced to a value equal to or less than about 148 cd/m$^2$. In other words, when a large amount of the blue pigment is mixed, particles of the blue pigment cover a large area of the particle surface of the second phosphor material, and thus the luminance is sharply reduced.

Considering the graphs of FIGS. 11A and 11B, when a content of the blue pigment ranges from 0.01 to 5 parts by weight, a reduction in the luminance can be prevented while the panel reflectance is reduced. A content of the blue pigment may range from 0.5 to 4 parts by weight.

Figure 12:
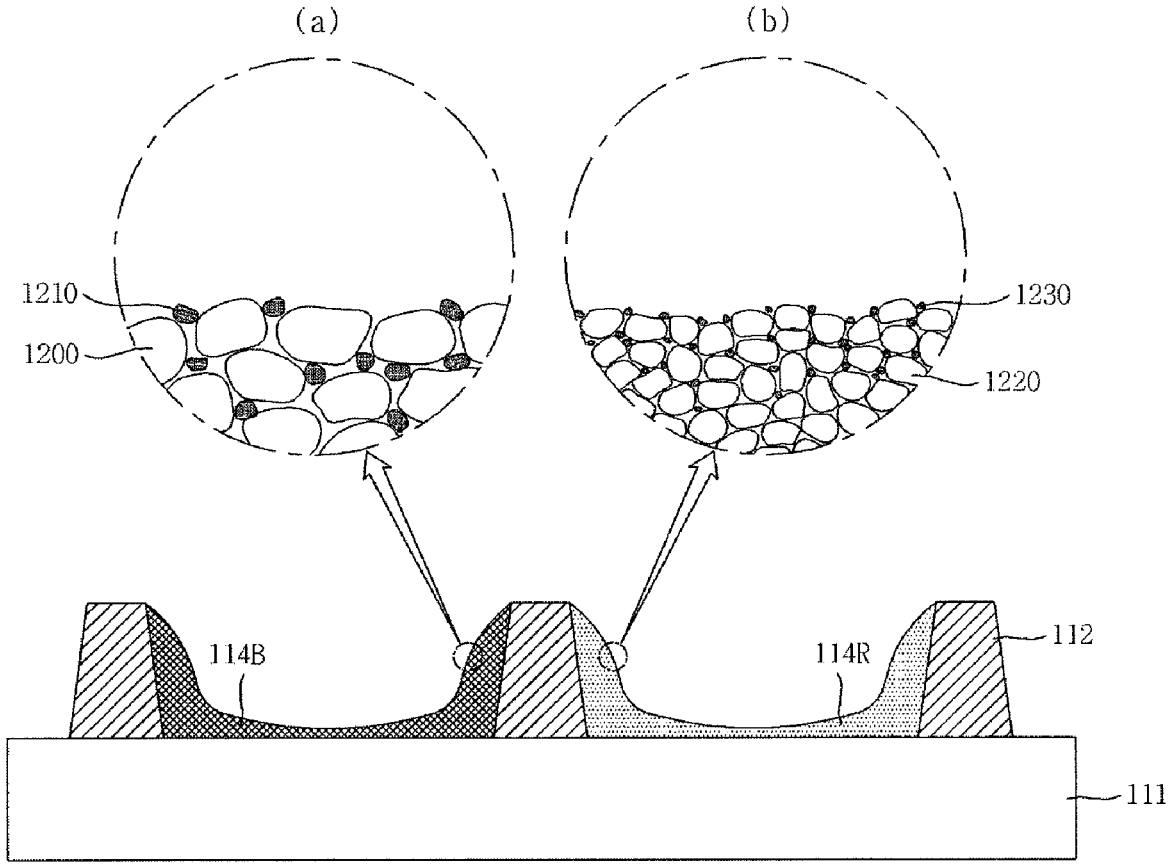
FIG. 12 is a diagram for explaining a difference between a particle size of a red pigment and a particle size of a blue pigment.

FIG. 12 is a diagram for explaining a difference between a particle size of a red pigment and a particle size of a blue pigment.

As shown in FIG. 12, (a) shows particles 1200 of a second phosphor material constituting a second phosphor layer 114B and particles 1210 of a blue pigment constituting the second phosphor layer 114B, and (b) shows particles 1220 of a first phosphor material constituting a first phosphor layer 114R and particles 1230 of a red pigment constituting the first phosphor layer 114R.

In FIG. 12, the size of the particles 1200 of the second phosphor material is larger than the size of the particles 1220 of the first phosphor material, and the size of the particles 1210 of the blue pigment is larger than the size of the particles 1230 of the red pigment.

As above, because the particles 1210 of the blue pigment mixed with the second phosphor material whose the size of the particles 1200 is relatively large are relatively large, the particles 1210 of the blue pigment are positioned not between the particles 1200 of the second phosphor material but on the surface of the second phosphor layer 114B. Accordingly, in case the size of the particles 1200 of the second phosphor material is relatively large, the reflectance can be reduced.

In other words, because the size of the particles 1210 of the blue pigment is larger than the size of the particles 1230 of the red pigment, an effect similar to the fact that a content of the blue pigment is more than a content of the red pigment can be obtained.

Figures 13A, 13B:
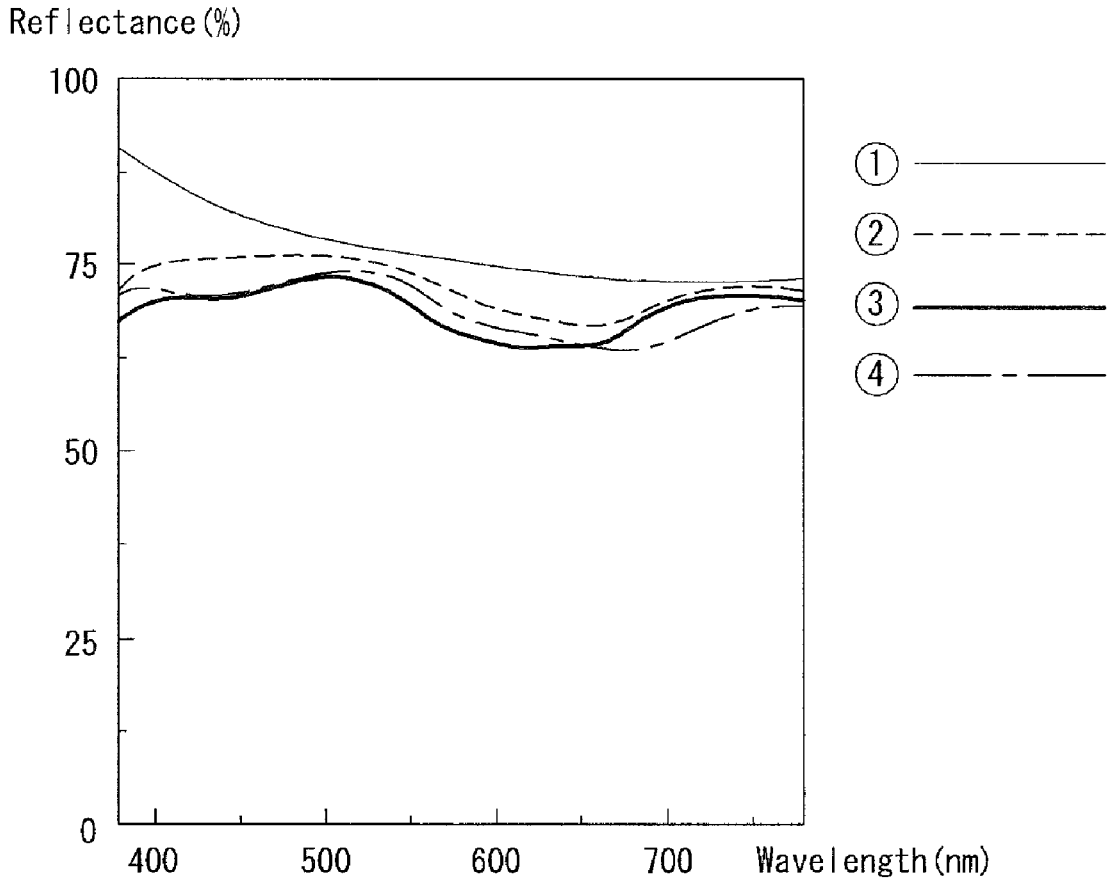
FIGS. 13A and 13B illustrate another example of a composition of a phosphor layer.

FIGS. 13A and 13B illustrate another example of a composition of a phosphor layer. A description in FIGS. 13A and 13B overlapping the description in FIG. 3 is briefly made or entirely omitted.

As shown in FIG. 13A, the third phosphor layer emitting green light includes a third phosphor material having a white-based color and a green pigment.

A description in FIG. 13A may be substantially the same as the description in FIG. 3 except that the third phosphor layer includes the green pigment.

The green pigment has a green-based color. The third phosphor layer may have a green-based color by mixing the green pigment with the third phosphor material. The green pigment is not particularly limited except the green-based color. The green pigment may include a zinc (Zn) material in consideration of facility of powder manufacture, color, and manufacturing cost.

The Zn-based material may exist in a state of zinc oxide, for instance, in a state of $ZnCO_2O_4$ in the third phosphor layer.

FIG. 13B is a graph showing a reflectance of a test model depending on a wavelength.

Similar to FIGS. 4A and 4B, a 7-inch test model on which a third phosphor layer emitting green light from all discharge cells is formed is manufactured. Then, light is directly irradiated on a barrier rib and the third phosphor layer of the test model in a state where a front substrate of the test model is removed to measure a reflectance of the test model.

The third phosphor layer includes a third phosphor material and a green pigment. The third phosphor material includes $Zn_2SiO_4$:$Mn^{+2}$ and $YBO_3$:$Tb^{+3}$ in a ratio of 5:5. The green pigment is a Zn-based material, and the Zn-based material in a state of $ZnCO_2O_4$ is mixed with the third phosphor material.

In FIG. 13B, ① indicates a case where the third phosphor layer does not include the green pigment. ② indicates a case where the third phosphor layer includes the green pigment of 0.1 part by weight. ③ indicates a case where the third phosphor layer includes the green pigment of 0.5 part by weight. ④ indicates a case where the third phosphor layer includes the green pigment of 1.0 part by weight.

In case of ① not including the green pigment, a reflectance is equal to or more than about 75% at a wavelength of 400 nm to 750 nm and is equal to or more than about 80% at a wavelength of 400 nm to 500 nm.

Because the third phosphor material having a white-based color reflects most of incident light, the reflectance in ① is high.

In case of ② including the green pigment of 0.1 part by weight, a reflectance is equal to or less than about 75% at a wavelength of 400 nm to 550 nm and ranges from about 66% to 70% at a wavelength of 550 nm to 700 nm.

In case of ③ including the green pigment of 0.5 part by weight, a reflectance is equal to or less than about 73% at a wavelength of 400 nm to 550 nm and ranges from about 63% to 65% at a wavelength more than 550 nm.

In case of ④ including the green pigment of 1.0 part by weight, a reflectance is similar to the reflectance in ③ at a wavelength of 400 nm to 750 nm.

Because the green pigment having a green-based color absorbs incident light, the reflectances in ②, ③ and ④ are less than the reflectance in ①.

The fact that the reflectances in ③ and ④ are similar to each other means that a reduction width of the panel reflectance is small although a content of the green pigment increases.

Figure 14B:
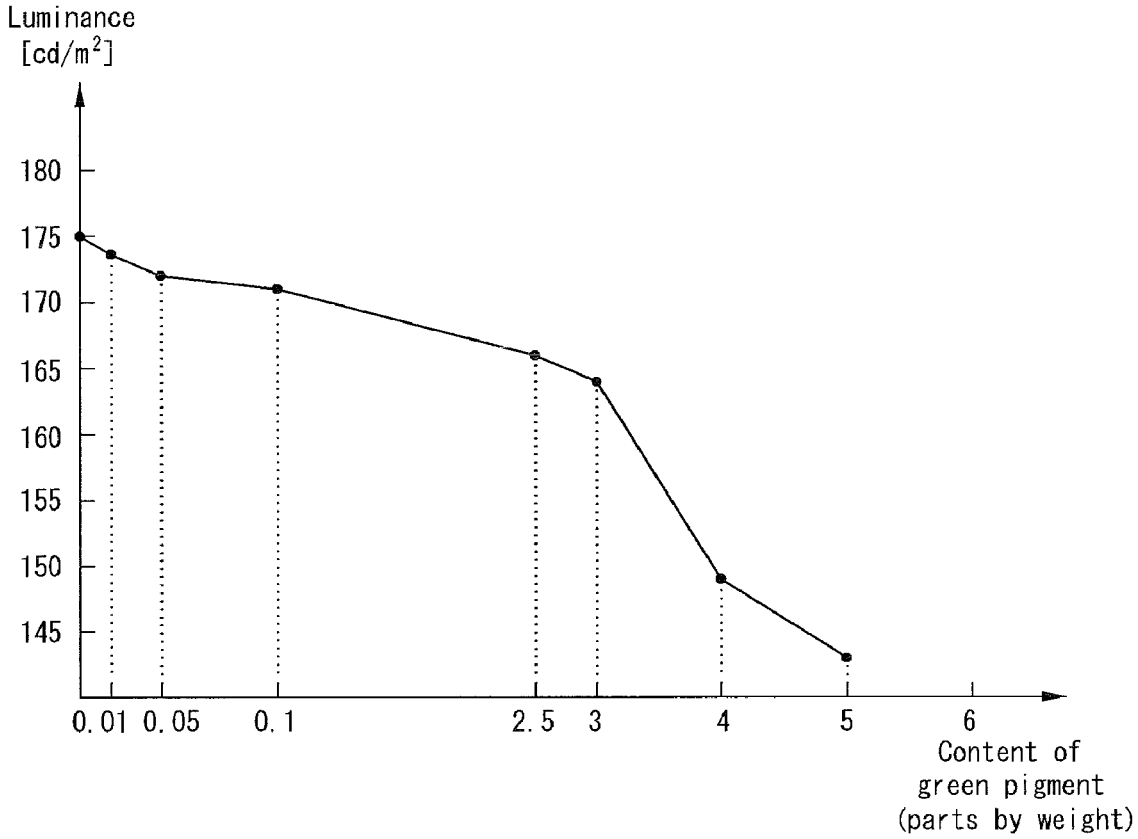

FIGS. 14A and 14B are a table and a graph showing a reflectance and a luminance of a plasma display panel depending on changes in a content of a green pigment, respectively.

In FIGS. 14A and 14B, the first phosphor layer is positioned inside the red discharge cell, the second phosphor layer is positioned inside the blue discharge cell, and the third phosphor layer is positioned inside the green discharge cell. Further, a reflectance and a luminance of the plasma display panel are measured depending on changes in a content of the green pigment mixed with the third phosphor layer in a state where the blue pigment of 1.0 part by weight is mixed with the second phosphor layer and the red pigment of 0.2 part by weight is mixed with the first phosphor layer. In this case, the reflectance and the luminance of the plasma display panel are measured in a panel state in which the front substrate and the rear substrate coalesce with each other.

The first phosphor material is (Y, Gd)BO:Eu. The red pigment is an Fe-based material, and the Fe-based material in a state of $\alpha Fe_2O_3$ is mixed with the first phosphor material.

The second phosphor material is (Ba, Sr, Eu)$MgAl_{10}O_{17}$. The blue pigment is a Co-based material, and the Co-based material in a state of $CoAl_2O_4$ is mixed with the second phosphor material.

The third phosphor material includes $Zn_2SiO_4$:$Mn^{+2}$ and $YBO_3$:$Tb^{+3}$ in a ratio of 5:5. The green pigment is a Zn-based material, and the Zn-based material in a state of $ZnCO_2O_4$ is mixed with the third phosphor material.

FIG. 14A is a table showing a reflectance at a wavelength of 550 nm.

As shown in FIG. 14A, when a content of the green pigment is 0, a panel reflectance is a relatively high value of 28%.

When a content of the green pigment is 0.01 part by weight, a panel reflectance is about 26.5%. When a content of the green pigment is 0.05 part by weight, a panel reflectance is about 26.2%.

When a content of the green pigment is 0.1 part by weight, a panel reflectance is about 26%. When a content of the green pigment is 0.2 part by weight, a panel reflectance is about 25.9%.

When a content of the green pigment greatly increases to 2.5 parts by weight, a panel reflectance falls to about 24.3%.

When a content of the green pigment is 3 parts by weight, a panel reflectance is about 24%.

When a content of the green pigment is 4, 5 and 7 parts by weight, respectively, a panel reflectance is about 23.8%, 23.5% and 22.8%, respectively.

As can be seen from FIG. 14A, when a content of the green pigment is equal to or more than 4 parts by weight, a reduction width of the panel reflectance is small.

FIG. 14B is a graph showing a luminance of the same image depending on changes in a content of the green pigment included in the third phosphor layer in a state where a content of each of the red pigment and the blue pigment is fixed.

As shown in FIG. 14B, a luminance of an image displayed when the third phosphor layer does not include the green pigment is about 175 cd/m$^2$.

When a content of the green pigment is 0.01 part by weight, a luminance of the image is reduced to about 174 cd/m$^2$. The green pigment can reduce the luminance of the image, because particles of the green pigment cover a portion of the particle surface of the third phosphor material, and thus hinder ultraviolet rays generated by a discharge inside the discharge cell from being irradiated on the particles of the third phosphor material.

When a content of the green pigment ranges from 0.05 to 2.5 parts by weight, a luminance of the image has a stable value of about 166 cd/m$^2$ to 172 cd/m$^2$.

When a content of the green pigment is 3 parts by weight, a luminance of the image is about 164 cd/m$^2$.

When a content of the green pigment is equal to or more than 4 parts by weight, a luminance of the image is sharply reduced to a value equal to or less than about 149 cd/m$^2$. In other words, when a large amount of the green pigment is mixed, the particles of the green pigment cover a large area of the particle surface of the third phosphor material and thus the luminance is sharply reduced.

Considering FIGS. 14A and 14B, when a content of the green pigment ranges from 0.01 to 3 parts by weight, a reduction in the luminance can be prevented while the panel reflectance is reduced. A content of the green pigment may range from 0.05 to 2.5 parts by weight.

A reduction width in the panel reflectance when a content of the green pigment increases is smaller than a reduction width in the panel reflectance when the red pigment and the blue pigment are mixed. Accordingly, a content of the green pigment may be smaller than a content of each of the red pigment and the blue pigment. Further, the green pigment may not be mixed.

Figure 15A:
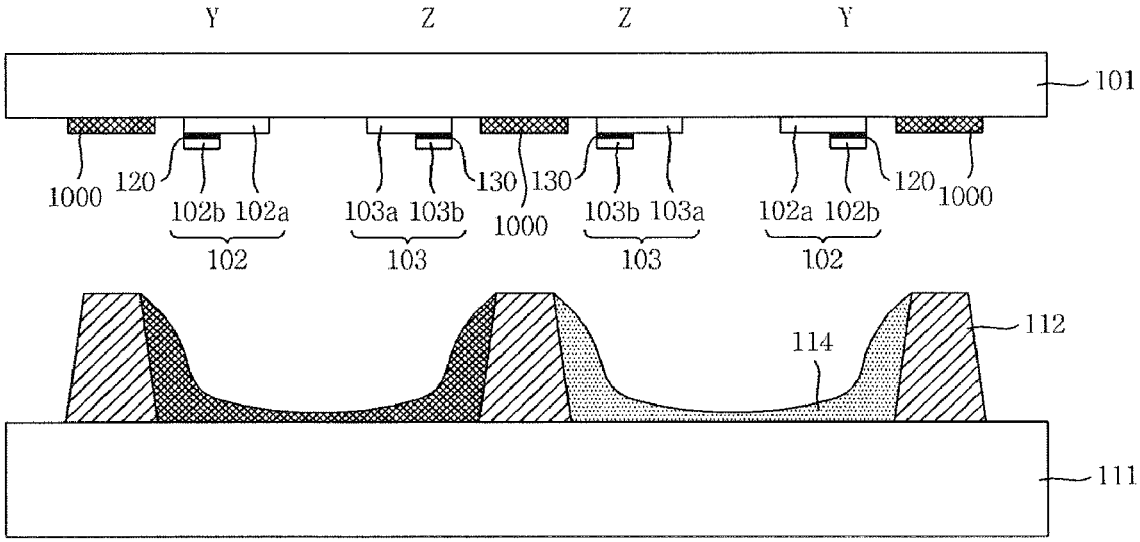
FIGS. 15A to 15C show another structure of a plasma display panel according to the exemplary embodiment.
Figure 15B:
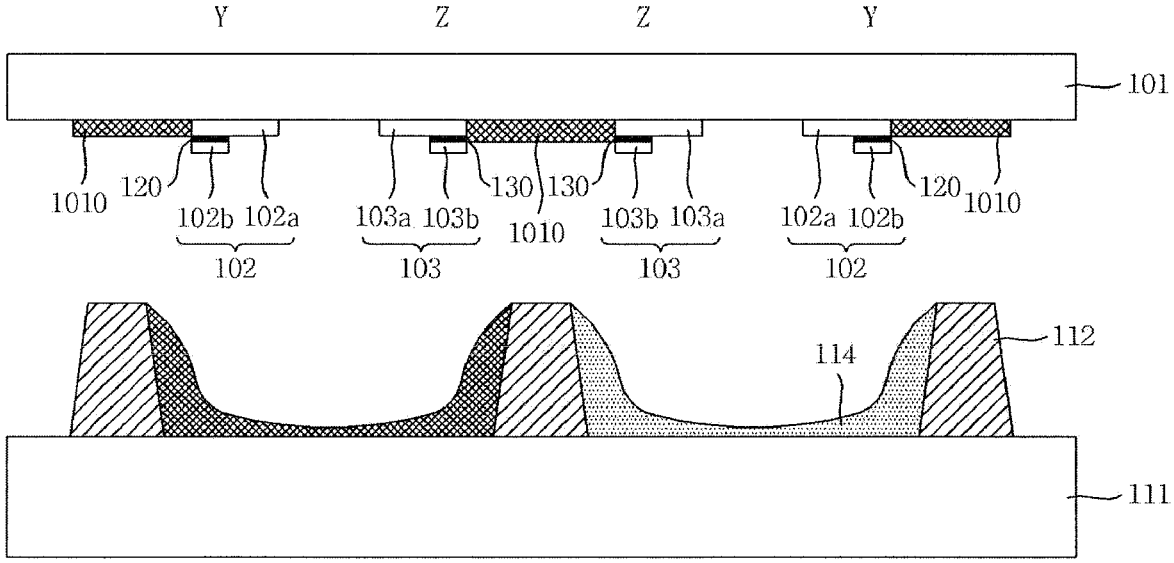
Figure 15C:
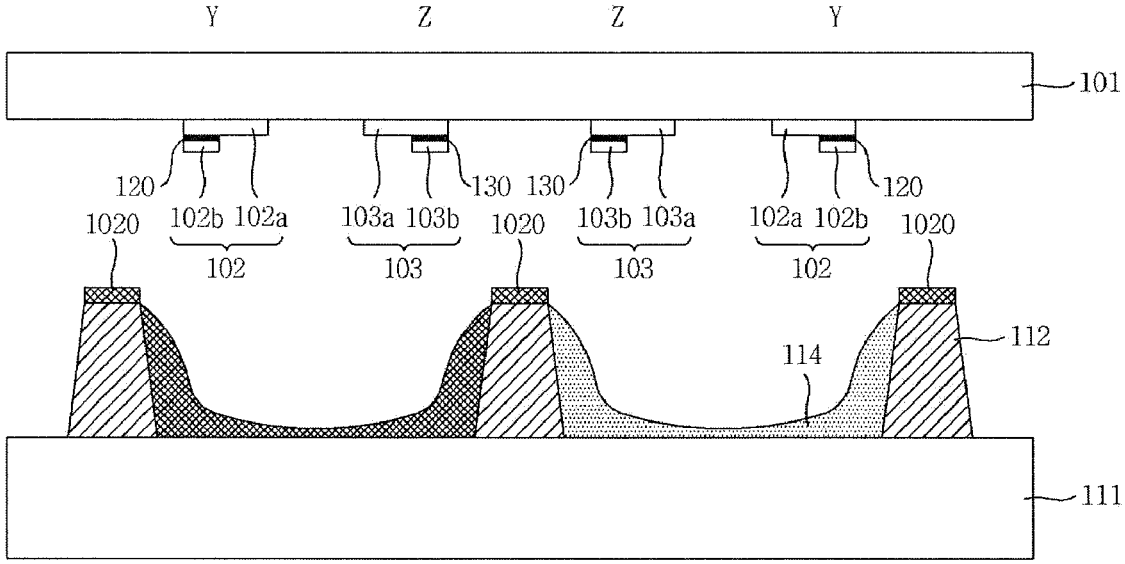

FIGS. 15A to 15C show another structure of a plasma display panel according to the exemplary embodiment.

As shown in FIG. 15A, a black matrix 1000 overlapping the barrier rib 112 is formed on the front substrate 101. The black matrix 1000 absorbs incident light and thus suppresses the reflection of light caused by the barrier rib 112. Hence, a panel reflectance is reduced and a contrast characteristic can be improved.

In FIG. 15A, the black matrix 1000 is formed on the front substrate 101. However, the black matrix 1000 may be positioned on the upper dielectric layer (not shown).

Black layers 120 and 130 are formed between the transparent electrodes 102*a* and 103*a* and the bus electrodes 102*b* and 103*b*. The black layers 120 and 130 prevent the reflection of light caused by the bus electrodes 102*b* and 103*b*, thereby reducing a panel reflectance.

As shown in FIG. 15B, a common black matrix 1010 contacting the two sustain electrodes 103 is formed between the two sustain electrodes 103. The common black matrix 1010 may be formed of the substantially same materials as the black layers 120 and 130. In this case, since the common black matrix 1010 can be manufactured when the black layers 120 and 130 is manufactured, time required in a manufacturing process can be reduced.

As shown in FIG. 15C, a top black matrix 1020 is directly formed on the barrier rib 112. Because the top black matrix 1020 reduces a panel reflectance, a black matrix may not be formed on the front substrate 101.

As described above, when a pigment is mixed with the phosphor layer, the panel reflectance can be further reduced. For instance, the first and second phosphor layers may include the red and blue pigments, respectively.

The black layers 120 and 130, the black matrix 1000, the common black matrix 1010 and the top black matrix 1020 may be omitted from the plasma display panel. Because the pigment mixed with the phosphor layer can sufficiently reduce the panel reflectance, a sharp increase in the panel reflectance can be prevented although the black layers 120 and 130, the black matrix 1000, the common black matrix 1010 and the top black matrix 1020 are omitted.

A removal of the black layers 120 and 130, the black matrix 1000, the common black matrix 1010 and the top black matrix 1020 can make a manufacturing process of the panel simpler, and reduce the manufacturing cost.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display panel comprising:

a front substrate;

a rear substrate facing the front substrate;

a barrier rib that is positioned between the front substrate and the rear substrate and partitions a discharge cell; and a phosphor layer formed on the discharge cell, the phosphor layer including a first phosphor layer emitting first color light, a second phosphor layer emitting second color light, and a third phosphor layer emitting third color light, wherein the first phosphor layer includes a first pigment and first phosphor particles, and the second phosphor layer includes a second pigment and second phosphor particles, an average particle size of the second phosphor particles of the second phosphor layer is larger than an average particle size of the first phosphor particles of the first phosphor layer, and a proportion of the second pigment to the second phosphor particles in the second phosphor layer by weight is higher than a proportion of the first pigment to the first phosphor particles in the first phosphor layer by weight.

2. The plasma display panel of claim 1, wherein the first color is red, the second color is blue, and the third color is green.

3. The plasma display panel of claim 2, wherein the proportion of the first pigment lies in a range between 0.01 and 5 parts by weight.

4. The plasma display panel of claim 2, wherein the proportion of the second pigment lies in a range between 0.01 and 5 parts by weight.

5. The plasma display panel of claim 1, wherein the first pigment includes iron (Fe).

6. The plasma display panel of claim 1, wherein the second pigment includes at least one of cobalt (Co), copper (Cu), chrome (Cr) or nickel (Ni).

7. The plasma display panel of claim 1, wherein the proportion of the first pigment satisfies the following equation: $0.005 \leqq C1/L1 \leqq 6$, where C1 is the proportion of the first pigment to the first phosphor particles in units of parts by weight, and L1 is an average particle size of the first phosphor particles in units of micrometer.

8. The plasma display panel of claim 1, wherein the proportion of the second pigment satisfies the following equation: $0.01 \leqq C2/L2 \leqq 8$, where C2 is the proportion of the second pigment to the second phosphor particles in units of parts by weight, and L2 is an average particle size of the second phosphor particles in units of micrometer.

9. A plasma display panel comprising:

a front substrate;

a rear substrate facing the front substrate;

a barrier rib that is positioned between the front substrate and the rear substrate and partitions a discharge cell; and a phosphor layer formed on the discharge cell, the phosphor layer including a first phosphor layer emitting first color light, wherein the first phosphor layer includes a first pigment and first phosphor particles, wherein a proportion of the first pigment to the first phosphor particles by weight in the first phosphor layer satisfies the following equation: $0.005 \leqq C1/L1 \leqq 6$, where C1 is the proportion of the first pigment to the first phosphor particles in units of parts by weight, and L1 is an average particle size of the first phosphor particles in units of micrometer.

10. The plasma display panel of claim 9, wherein the first color is red.

11. The plasma display panel of claim 10, wherein the first pigment includes iron (Fe).

12. The plasma display panel of claim 10, wherein the proportion of the first pigment to the first phosphor particles lies in a range between 0.01 and 5 parts by weight.

13. A plasma display panel comprising:

a front substrate;

a rear substrate facing the front substrate;

a barrier rib that is positioned between the front substrate and the rear substrate and partitions a discharge cell; and a phosphor layer formed inside the discharge cell, the phosphor layer including a second phosphor layer emitting second color light, wherein the second phosphor layer includes a second pigment and second phosphor particles, wherein a proportion of the second pigment to the second phosphor particles by weight in the second phosphor layer satisfies the following equation: $0.01 \leqq C2/L2 \leqq 8$, where C2 is the proportion of the second pigment to the second phosphor particles in units of parts by weight, and L2 is an average particle size of the second phosphor particles in units of micrometer.

14. The plasma display panel of claim 13, wherein the second color is blue.

15. The plasma display panel of claim 14, wherein the second pigment includes at least one of cobalt (Co), copper (Cu), chrome (Cr) or nickel (Ni).

16. The plasma display panel of claim 14, wherein the proportion of the second pigment to the second phosphor particles lies in a range between 0.01 and 5 parts by weight.

17. A plasma display panel comprising:

a first discharge cell having a first phosphor layer formed thereon, the first phosphor layer having a plurality of first phosphor particles and a plurality of first pigment particles;

a second discharge cell having a second phosphor layer formed thereon, the second phosphor layer having a plurality of second phosphor particles and a plurality of second pigment particles, wherein an average size of the first phosphor particles being larger than an average size of the second phosphor particles and an average size of the first pigment particles being larger than an average size of the second pigment particles.

18. The plasma display of claim 17, wherein a proportional weight of the first pigment particles to the first phosphor particles in the first phosphor layer is greater than a proportional weight of the second pigment particles to the second phosphor particles in the second phosphor layer.

19. The plasma display of claim 17, wherein an amount of the first pigment particles in the first phosphor layer is dependent on the average size of the first phosphor particles.

20. The plasma display of claim 17, wherein a ratio of a proportion of the first pigment particles by weight in the first phosphor layer to the average size of the first phosphor particles measured in micrometers is between 0.005 and 6, and a ratio of a proportion of the second pigment particles by weight in the second phosphor layer to the average size of the second phosphor particles measured in micrometers is between 0.01 and 8.

* * * * *